US011808274B2

(12) United States Patent
Jung et al.

(10) Patent No.: US 11,808,274 B2
(45) Date of Patent: Nov. 7, 2023

(54) BLOWER

(71) Applicant: LG ELECTRONICS INC., Seoul (KR)

(72) Inventors: Jaehyuk Jung, Seoul (KR); Kidong Kim, Seoul (KR); Hyungho Park, Seoul (KR); Hoojin Kim, Seoul (KR); Haein Jung, Seoul (KR); Yongmin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/318,242

(22) Filed: May 12, 2021

(65) Prior Publication Data

US 2021/0355947 A1 Nov. 18, 2021

(30) Foreign Application Priority Data

May 14, 2020 (KR) ..... 10-2020-0057728
Jun. 2, 2020 (KR) ..... 10-2020-0066278
(Continued)

(51) Int. Cl.
*F04D 25/08* (2006.01)
*F04D 29/44* (2006.01)
(Continued)

(52) U.S. Cl.
CPC ..... *F04D 25/08* (2013.01); *F04D 25/0606* (2013.01); *F04D 29/441* (2013.01); *F04D 29/703* (2013.01); *F04F 5/16* (2013.01)

(58) Field of Classification Search
CPC ..... F04D 25/0606; F04D 25/08; F04D 25/14; F04D 29/441; F04D 29/703;
(Continued)

(56) References Cited

U.S. PATENT DOCUMENTS 9,255,722 B2 * 2/2016 Kim ..... F24F 13/20
9,759,445 B2 * 9/2017 Kim ..... F24F 13/10
(Continued)

FOREIGN PATENT DOCUMENTS

AU 2012200112 2/2012
CN 100567830 C * 12/2009 ..... C02F 1/72
(Continued)

OTHER PUBLICATIONS

English translation of CN206144830U (Year: 2017).*
(Continued)

*Primary Examiner* — Igor Kershteyn
*Assistant Examiner* — Wesley Le Fisher
(74) *Attorney, Agent, or Firm* — KED & Associates LLP

(57) ABSTRACT

A blower includes a first tower and a second tower spaced apart from each other each having discharge ports that face each other. A gate is movably installed in at least one of the first tower or the second tower to protrude into and out of the space between the first and second towers to change a flow of air discharged out of the discharge ports. A guide motor may be configured to move the gate. The discharge ports may be provided at a rear side of the space to discharge air toward a front of the space, while the gate may be moved to cover the front side of the space to guide air upward.

21 Claims, 31 Drawing Sheets

(30) Foreign Application Priority Data

Jun. 2, 2020 (KR) ..... 10-2020-0066279
Jun. 2, 2020 (KR) ..... 10-2020-0066280

(51) Int. Cl.
*F04D 29/70* (2006.01)
*F04F 5/16* (2006.01)
*F04D 25/06* (2006.01)

(58) Field of Classification Search
CPC ..... F04D 29/524; F04D 25/10; F04F 5/16; F24F 13/10; F24F 13/12; F24F 13/14; F24F 13/16
See application file for complete search history.

(56) References Cited

U.S. PATENT DOCUMENTS

| | | | | |
|---|---|---|---|---|
| 10,184,495 | B2 * | 1/2019 | Iyer | F24F 1/01 |
| 10,969,122 | B2 * | 4/2021 | Kim | F24F 13/14 |
| 11,624,369 | B2 * | 4/2023 | Jung | F04D 29/441 415/182.1 |
| 2007/0129001 | A1 * | 6/2007 | Orr | F24F 11/0001 454/239 |
| 2010/0226801 | A1 | 9/2010 | Gammack | |
| 2012/0051884 | A1 * | 3/2012 | Junkel | F04F 5/16 415/90 |
| 2014/0147297 | A1 | 5/2014 | Iyer et al. | |
| 2017/0254548 | A1 * | 9/2017 | Song | F24F 1/0011 |
| 2018/0306452 | A1 * | 10/2018 | Kim | F24F 1/0073 |
| 2023/0071183 | A1 * | 3/2023 | Lee | F04F 5/16 |

FOREIGN PATENT DOCUMENTS

| | | | | |
|---|---|---|---|---|
| CN | 101793431 | | 8/2010 | |
| CN | 201884310 | | 6/2011 | |
| CN | 203189361 | | 9/2013 | |
| CN | 203614369 | | 5/2014 | |
| CN | 203687304 | U * | 7/2014 | |
| CN | 205332468 | | 6/2016 | |
| CN | 106123264 | | 11/2016 | |
| CN | 106152461 | A * | 11/2016 | |
| CN | 106705240 | A * | 5/2017 | F24F 1/0014 |
| CN | 206144830 | U * | 5/2017 | |
| CN | 206877265 | | 1/2018 | |
| GB | 2568979 | | 6/2019 | |
| JP | 2013-015114 | | 1/2013 | |
| JP | 2015-152005 | | 8/2015 | |
| JP | 6650562 | B2 * | 2/2020 | F04D 25/08 |
| KR | 10-2011-0099318 | | 9/2011 | |
| KR | 10-2011-0100274 | | 9/2011 | |
| KR | 10-2013-0033435 | | 4/2013 | |
| KR | 20170066025 | A * | 6/2017 | |
| KR | 10-2018-0125425 | | 11/2018 | |
| KR | 10-2019-0015325 | | 2/2019 | |
| KR | 10-2019-0025443 | | 3/2019 | |
| WO | WO 2013/035271 | | 3/2013 | |
| WO | WO 2017/11058 | | 6/2017 | |
| WO | WO 2017/198763 | | 11/2017 | |

OTHER PUBLICATIONS

English translation of JP6650562B2 (Year: 2020).*
English translation of CN106152461A (Year: 2016).*
English translation of CN203687304U (Year: 2014).*
English translation of CN100567830C (Year: 2009).*
English translation of CN106705240A (Year: 2017).*
English translation of KR20170066025A (Year: 2017).*
Taiwan Office Action issued in Application No. 110117161 dated Jan. 3, 2022.
European Search Report issued in Application No. 21173601.2 dated Nov. 11, 2021.
Korean Office Action dated Oct. 25, 2021 issued in Application No. 10-2020-0057728.
Chinese Office Action dated Oct. 10, 2022 issued in CN Application No. 202110521265.6.
Chinese Office Action dated Nov. 3, 2022 issued in CN Application No. 202110521288.7.
Korean Office Action dated Apr. 6, 2023 issued in Application No. 10-2020-0066278.

* cited by examiner

BLOWER

CROSS-REFERENCE TO RELATED APPLICATIONS

This application claims priority under 35 U.S.C. § 119 to Korean Application Nos. 10-2020-0057728 filed on May 14, 2020; 10-2020-0066278 filed on Jun. 2, 2020; 10-2020-0066279 filed on Jun. 2, 2020; and 10-2020-0066280 filed on Jun. 2, 2020, whose entire disclosures are hereby incorporated by reference.

BACKGROUND

1. Field

The present disclosure relates to a blower.

2. Background

A blower may generate a flow of air to circulate air in an indoor space or to guide airflow toward a user. Recent blowers have been aimed at providing users with a better sense of comfort.

Korean Patent Publication Nos. KR2011-0099318, KR2011-0100274, KR2019-0015325, and KR2019-0025443 disclose a blowing device using a Coanda effect. Blowers may require a plurality of independently drive motors to move or rotate the blower so as to adjust a blowing direction. Effectively and gradually adjusting a blowing direction may be difficult, especially without consuming excessive power.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
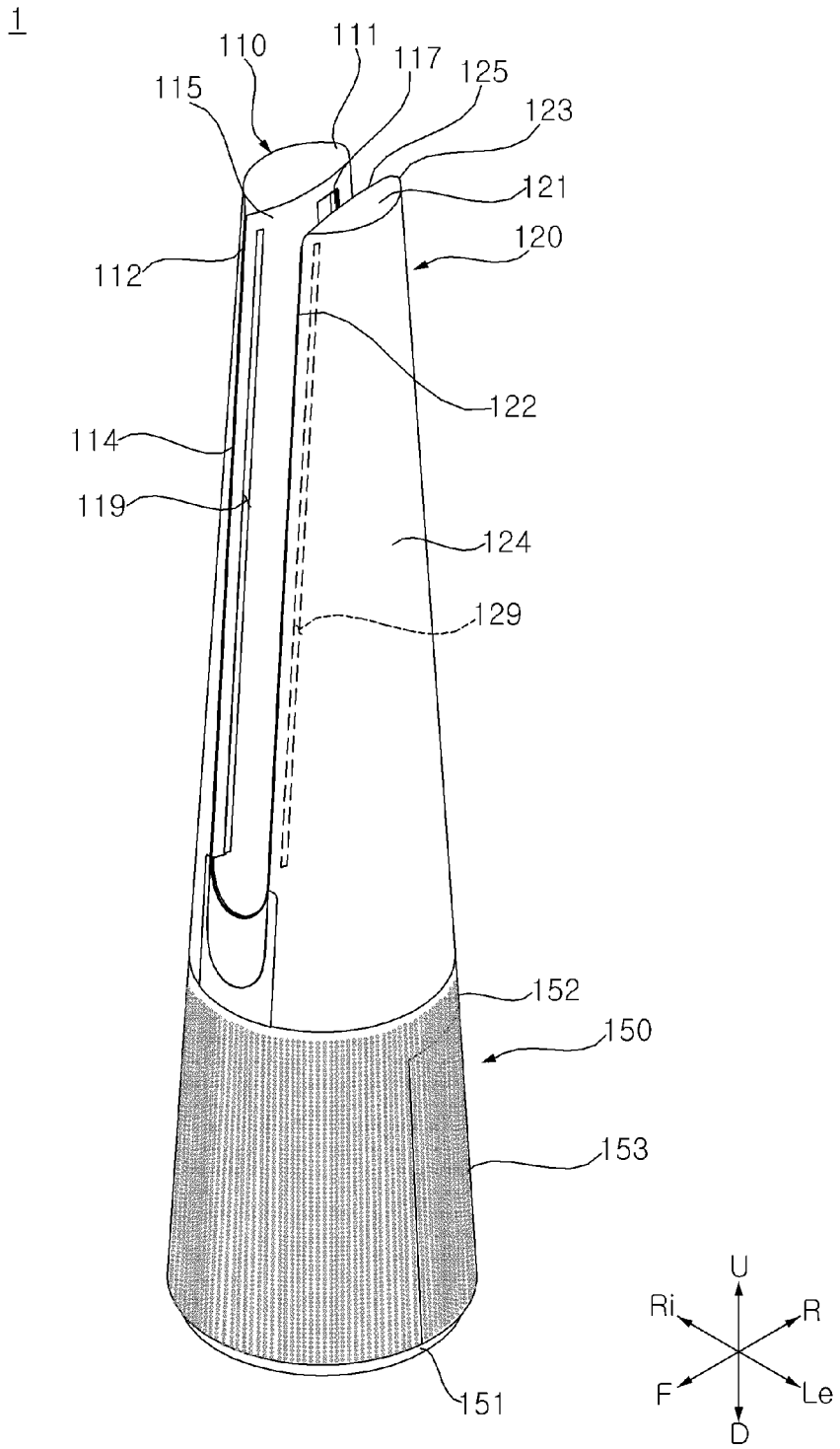
FIG. 1 is a perspective view of a blower according to a first embodiment.

The direction indications of up (U), down (D), left (Le), right (Ri), front (F), and rear (R) shown in FIGS. 1 to 11, 16 to 22, and 24A to 27 are used for convenience of description and do not limit the scope of embodiments disclosed herein. Therefore, when a reference view is changed, the above direction may be set differently.

Referring to FIGS. 1 to 4, a blower 1 may include a case 100 providing an outer shape and/or defining an exterior appearance. The case 100 may include a base case 150 in which a filter 200 may be detachably installed and a tower case 140 configured to discharge air based on the Coanda effect. The base case 150 and the tower case 140 may alternatively be referred to as lower and upper cases, respectively.

The tower case 140 may include a first tower or case 110 and a second tower or case 120 that may be separated. The first and second towers 110 and 120 may extend vertically to appear as two columns. The first tower 110 may be provided at a right side (as defined by the "Ri" direction in FIG. 1), and the second tower 120 may be provided at a left side (as defined by the "Le" direction in FIG. 1).

The first tower 110 and the second tower 120 may be spaced apart in the Right-Left direction. The first and second towers 110 and 120 may have inner spaces through which air flows. A blowing space 105 may be formed between the first tower 110 and the second tower 120 in which air flowing through the first and second towers 110 and 120 is discharged.

The front, rear, and upper sides of the blowing space 105 may be opened. Upper and lower ends of the blowing space 105 may be have an equal left-right length such that a distance between the first and second towers 110 and 120 may be equal at upper and lower sides.

The tower case 140 as a whole may be formed in a truncated cone shape. Discharge ports 117 and 127 may be respectively provided in the first tower 110 and the second tower 120 to discharge air to the blowing space 105. A first discharge port 117 may be formed in the first tower 110 to discharge air flowing inside of the first tower 110, and a second discharge port 127 may be formed in the second tower 120 to discharge air flowing inside of the second tower 120.

Each of the first and second discharge ports 117 and 127 may face the blowing space 105 or otherwise be configured to discharge air into the blowing space 105. The air discharged through the first discharge port 117 or the second discharge port 127 may be discharged in a direction crossing the blowing space 105. Air discharge directions of the air discharged through the first tower 110 and the second tower 120 may be formed in a front-rear direction and an up-down direction.

Figure 2:
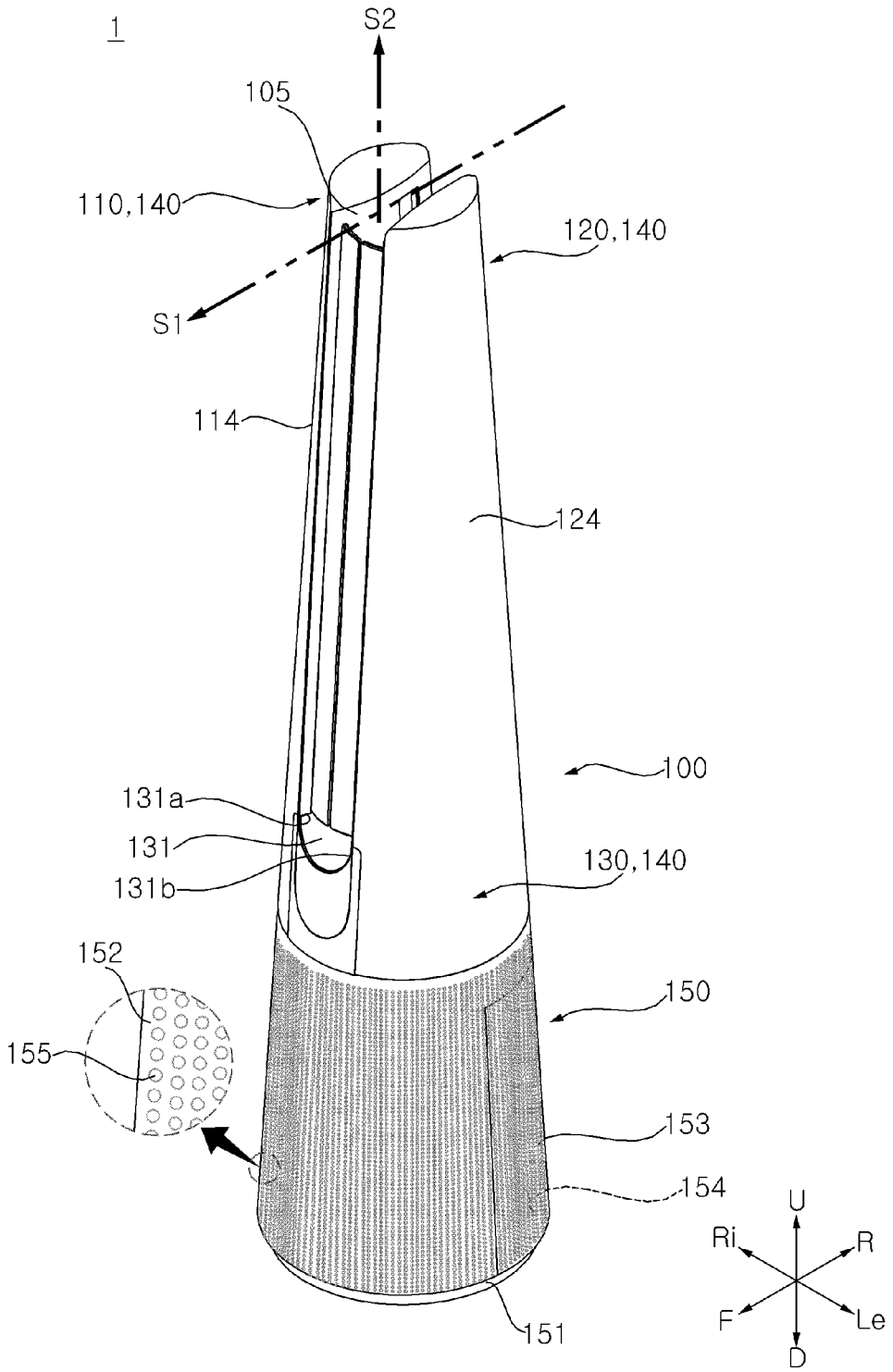
FIG. 2 is an exemplary view of the operation of FIG. 1.

Referring to FIG. 2, the air discharge direction crossing the blowing space 105 may include a first air discharge direction S1 provided in a horizontal (and front-rear) direction and a second air discharge direction S2 formed in a vertical direction. Air flowing in the first air discharge direction S1 may be defined as a horizontal airflow, and air flowing in the second air discharge direction S2 may be defined as an upward airflow.

The horizontal airflow means that the main air flow direction may be a horizontal direction and may mean that the flow rate of the air flowing in the horizontal direction may be increased. Similarly, the upward airflow means that the main air flow direction may be an upward direction and may mean that the flow rate of the air flowing in the upward direction may be increased.

Upper and lower left-right lengths of the blowing space 105 may be formed to be the same. The upper left-right length of the blowing space 105 may be a distance between an upper end of the first tower 110 and a upper end of the second tower 120. The lower left-right length of the blowing space 105 may be a distance between a lower end of the first tower 110 and a lower end of the second tower 120. Alternatively, the upper and lower lengths of the blowing space 105 may be formed to be different such that the blowing space 105 may be narrower or wider at an upper end. By forming the left-right lengths of the blowing space 105 to be uniform, however, a flow of air flowing toward a front side of the blowing space 105 may be more uniform.

For example, when the upper and lower left-right lengths of the blowing space 105 are different, a flow velocity at the end having the longer distance may be reduced, and a deviation of velocity in the vertical direction may occur. When a deviation in flow velocity occurs with respect to the vertical direction, a position where air may reach or be guided to may vary.

The air discharged from the first discharge port 117 may join or mix with the air discharged from the second discharge port 127 in the blowing space 105, and then flow in the first and second air discharge directions S1 and/or S2. The blowing space 105 may be used as a space in which discharge air streams may be joined and mixed. In addition, the air at the rear side of the blowing space 105 may also be guided through the blowing space 105 toward a front side.

The air discharged from the first discharge port 117 and the second discharge port 127 may be joined in the blowing space 105, and induced to flow in a relatively straight flow in the S1 direction. By joining the discharged air of the first discharge port 117 and the second discharge port 127 in the blowing space 105, the ambient air around the first and second towers 110 and 120 may also be indirectly guided to flow in the first and/or second air discharge directions S1 and/or S2.

Referring to FIGS. 1-2, an upper end 111 of the first tower 110 and an upper end 121 of the second tower 120 may be spaced apart to facilitate air flow in the second air discharge direction S2. The air discharged in the second air discharge direction S2 may not interfere with the case of the blower 1.

To facilitate flow in the first air discharge direction S1, a front end 112 of the first tower 110 and a front end 122 of the second tower 120 may be spaced apart, and a rear end 113 of the first tower 110 and a rear end 123 of the second tower 120 may be also spaced apart. Walls of the first tower 110 and the second tower 120 facing the blowing space 105 may be referred to as inner walls, and walls not facing the blowing space 105 may be referred to as outer walls.

Figure 4:
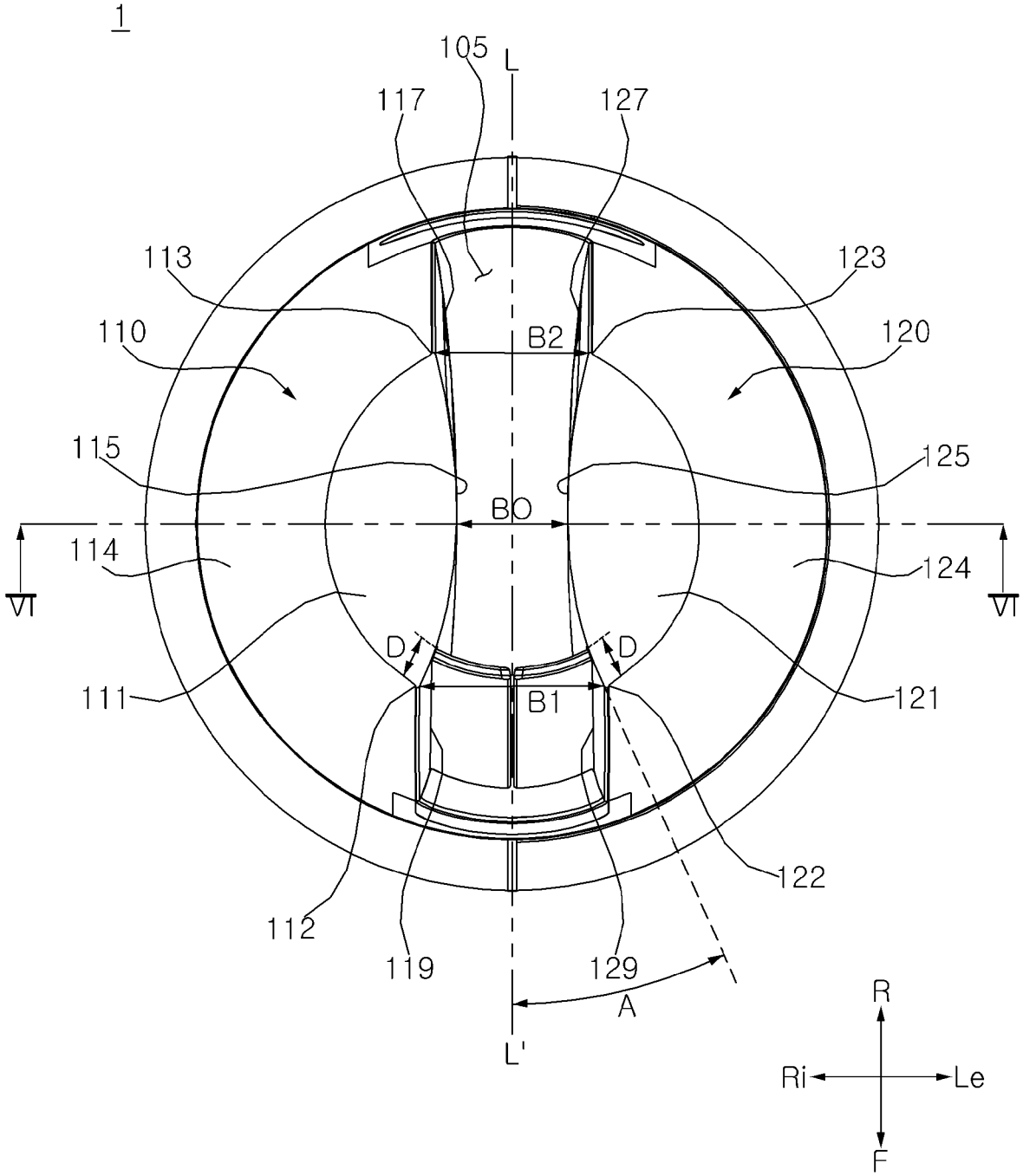
FIG. 4 is a plan view of FIG. 1.

Referring to FIG. 4, an outer wall 114 of the first tower 110 (or a first outer wall 114) and an outer wall 124 of the second tower 120 (or a second outer wall 124) may face opposite directions. The inner wall 115 of the first tower 110 (or a first inner wall 115) and the inner wall (125 of the second tower 120 (or a second inner wall 125) may face each other.

The first inner wall 115 may have a convex curvature to be curved toward the second tower 120, and the second inner wall 125 may have a convex curvature to be curved toward the first tower 110.

The first tower 110 and the second tower 120 may be formed in a streamlined shape with respect to the flow direction of air. The first inner wall 115 and the first outer wall 114 may be formed in a streamline shape to reduce drag and/or deflect air in the front-rear direction, and the second inner wall 125 and the second outer wall 124 may similarly be formed in a streamline shape to reduce drag and/or deflect air in the front-rear direction.

For example, the first inner wall 115 and the first outer wall 114 may join at the front end 112 of the first tower 110 to form an edge and also join at the rear end 113 of the first tower 110 to form an edge. An overall shape of the first tower 110 may be similar to an airplane wing. Similarly, the second inner wall 125 and the second outer wall 125 may join at the front end 122 of the second tower 120 to form an edge and also join at the rear end 123 of the second tower 120 to form an edge. An overall shape of the second tower 120 may be similar to an airplane wing.

The first discharge port 117 may be provided in the first inner wall 115, and the second discharge port 127 may be provided in the second inner wall 125. The first inner wall 115 and the second inner wall 125 may be spaced apart by a center distance B0 at a central portion 115*a* of the first inner wall 115 and a central portion 125*a* of the second inner wall 125. The center distance B0 may be a shortest or minimum distance between the first and second inner walls 115 and 125 due to a curvature of the first and second inner walls 115 and 125.

The central portion 115*a* of the first inner wall 115 may be an area located between the front end 112 and the rear end 113 of the first inner wall 115. Similarly, the central portion 125*a* of the second inner wall 125 may be an area located between the front end 122 and the rear end 123 of the second inner wall 125.

Each of the first discharge port 117 and the second discharge port 127 may be provided at a rear side of the central portion 115*a* of the first inner wall 115 and the central portion 125*a* of the second inner wall 125. The first discharge port 117 may be provided between the central portion 115*a* and the rear end 113 of the first inner wall 115. The second discharge port 127 may be provided between the central portion 125*a* and the rear end 123 of the second inner wall 125.

A distance between the front end 112 of the first tower 110 and the front end 122 of the second tower 120 may be referred to as a first distance B1 or alternatively as a front end distance B1. A distance between the rear end 113 of the first tower 110 and the rear end 123 of the second tower 120 may be referred to as a second distance B2 or alternatively as a rear end distance B2.

The first distance B1 and the second distance B2 may be longer than the center distance B0. The first distance B1 and the second distance B2 may be equal, or alternatively, different.

The first and second inner walls 115 and 125 may be collectively referred to as the inner walls 115, 125. The first and second discharge ports 117, 127 may be collectively referred to as the discharge ports 117, 127. The first and second outer walls 114 and 124 may be collectively referred to as the outer walls 114, 124. The first and second front ends 112 and 122 may collectively be referred to as the front ends 112, 122. The first and second rear ends 113 and 123 may collectively be referred to as the rear ends 113, 123.

As the discharge ports 117, 127 may be provided closer to the rear ends 113, 123, an airflow may be easier to control using the Coanda effect described in more detail later. The inner wall 115 of the first tower 110 and the inner wall 125 of the second tower 120 may be configured to facilitate a Coanda effect, and the outer wall 114 of the first tower 110 and the outer wall 124 of second tower 120 may be configured to indirectly provide a Coanda effect.

The inner walls 115, 125 may be configured to directly guide the air discharged from the discharge ports 117, 127 to the front ends 112, 122. The inner walls 115, 125 may directly facilitate a horizontal airflow of the air discharged from the discharge ports 117, 127.

Due to the air flow in the blowing space 105, indirect air flow may occur at the outer walls 114, 124 as well. The outer wall s114, 124 may be configured to induce a Coanda effect with respect to an indirect air flow and may guide such indirect air flow to the front ends 112, 122.

The left side of the blowing space may be blocked by the first inner wall 115, and the right side of the blowing space may be blocked by the second inner wall 125. The upper side of the blowing space 105 may be opened or not blocked.

An air flow guide or converter 400 (see FIGS. 7 and 11) described later may convert a horizontal airflow passing through the blowing space 105 into an upward airflow, and the upward airflow may flow to the open upper side of the blowing space 105. The upward airflow may suppress a direct flow of discharged air to a user, and may actively convect the indoor air.

In addition, a width of a stream of the discharge air may be adjusted through a flow rate of the air joined in the blowing space 105. By forming a vertical length of the first discharge port 117 and the second discharge port 127 to be much longer than the left and right widths if the center, first, and second distances B0, B1, B2, the discharged air of the first discharge port 117 and the discharged air of the second discharge port 127 may be induced to join in the blowing space 105.

Figure 3:
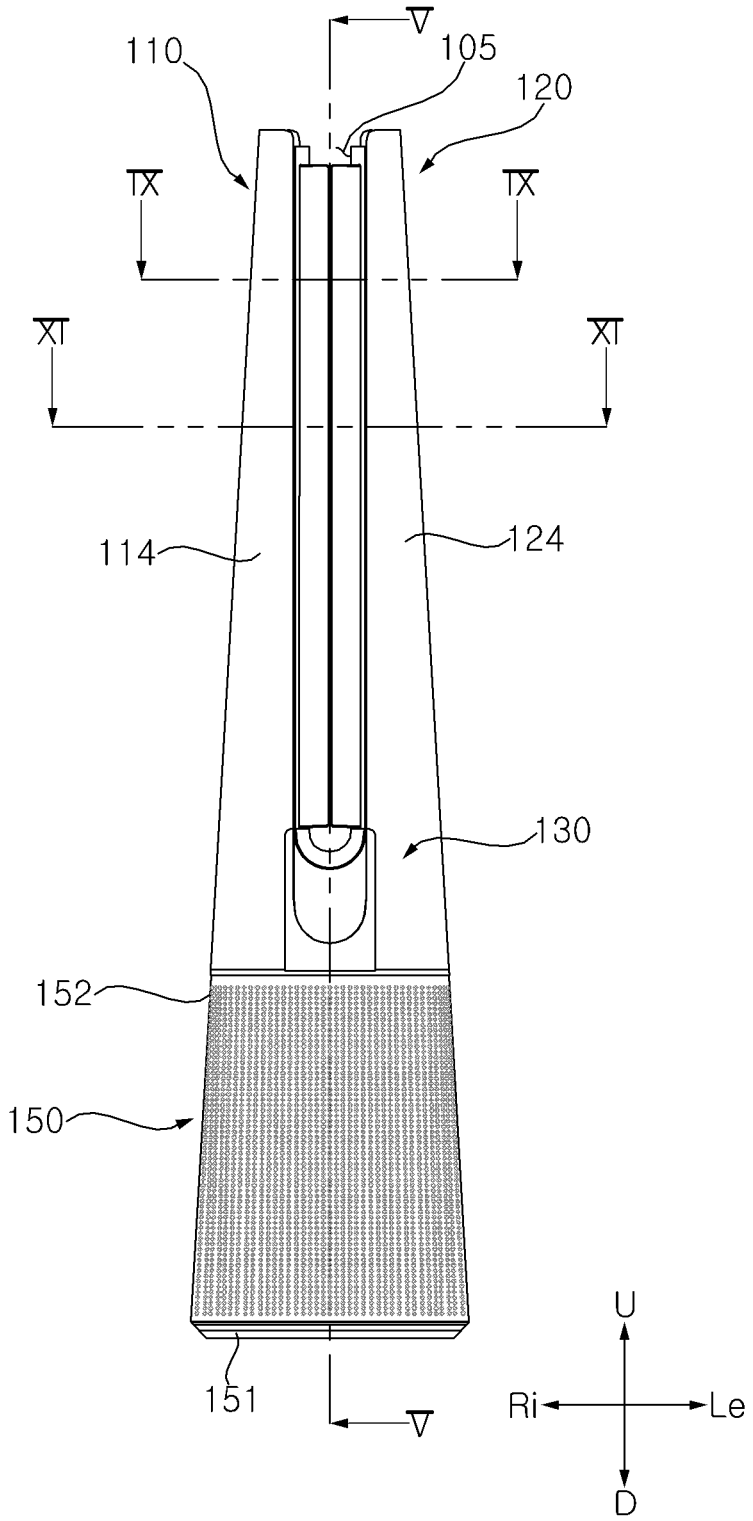
FIG. 3 is a front view of FIG. 1.

Referring to FIGS. 1 to 3, a tower base 130 may connect the first tower 110 and the second tower 120, and the tower base 130 may be assembled to the base case 150. The tower base 130 may be manufactured integrally with the first tower 110 and the second tower 120 or alternatively manufactured separately and later combined. As another alternative, the tower base 130 may be omitted, and the first tower 110 and the second tower 120 may be directly coupled to the base case 150 or may be manufactured integrally with the base case 150.

The base case 150 may form a lower portion of the blower 1, and the tower case 140 may form an upper portion of the blower 1. The blower 1 may suction ambient air from the base case 150 and discharge the filtered air in the tower case 140. The tower case 140 may discharge air from a position higher than the base case 150.

The blower 1 may have a pillar shape whose diameter decreases toward the upper portion. The blower 1 may have a conical or truncated cone shape as a whole, but embodiments disclosed herein are not limited. For example, the blower 1 may include two straight towers 110 and 120 that do not become narrower in an upward direction (e.g., straight towers). However, when a cross section of the blower 1 becomes narrower in the upward direction, a center of gravity may be lowered, reducing a risk of overturning or tipping due to external force.

For convenience of assembly, the base case 150 and the tower case 140 may be separately manufactured. Alternatively, the base case 150 and the tower case 140 may be integrally formed. For example, the base case 150 and the tower case 140 may be manufactured in the form of a front case and a rear case which may be integrally manufactured and then assembled.

The base case 150 may be formed to gradually decrease in diameter toward an upper side. The tower case 140 may be also be formed to gradually decrease in diameter toward an upper side.

Outer surfaces of the base case 150 and the tower case 140 may be formed to be continuous. A lower end of the tower base 130 and an upper end of the base case 150 may be in close contact, and an outer surface of the tower base 130 and the outer surface of the base case 150 may form a continuous surface. A lower end diameter of the tower base 130 may be the same as or slightly smaller than an upper end diameter of the base case 150.

The tower base 130 may distribute air supplied from the base case 150 and provide the distributed air to the first tower 110 and the second tower 120. The tower base 130 may connect the first tower 110 and the second tower 120. The blowing space 105 may be provided above the tower base 130.

In addition, the discharge port 117, 127 may be provided in the upper side of the tower base 130, and an upward airflow and a horizontal airflow may be formed in the upper side of the tower base 130. In order to reduce or minimize drag or friction with air, the upper surface 131 of the tower base 130 may be formed as a curved surface that curves downward to have a concave curvature that extends in the front-rear direction. Referring to FIG. 2, one or a first side 131*a* of the upper surface 131 may be connected to the first inner wall 115, and the other or a second side 131*b* of the upper surface 131 may be connected to the second inner wall 125.

Referring to FIG. 4, when viewed from a top, the first tower 110 and the second tower 120 may be vertically symmetrical with respect to a center line L-L'. The first discharge port 117 and the second discharge port 127 may be provided to be vertically symmetrical with respect to the center line L-L'.

The center line L-L' may be a virtual line between the first tower 110 and the second tower 120 and may extend in the front-rear direction. The center line L-L' may pass through the upper surface 131. Alternatively, the first tower 110 and the second tower 120 may be formed in an asymmetric shape. However, a symmetric arrangement may be advantageous in controlling a horizontal airflow and an upward airflow.

Figure 5:
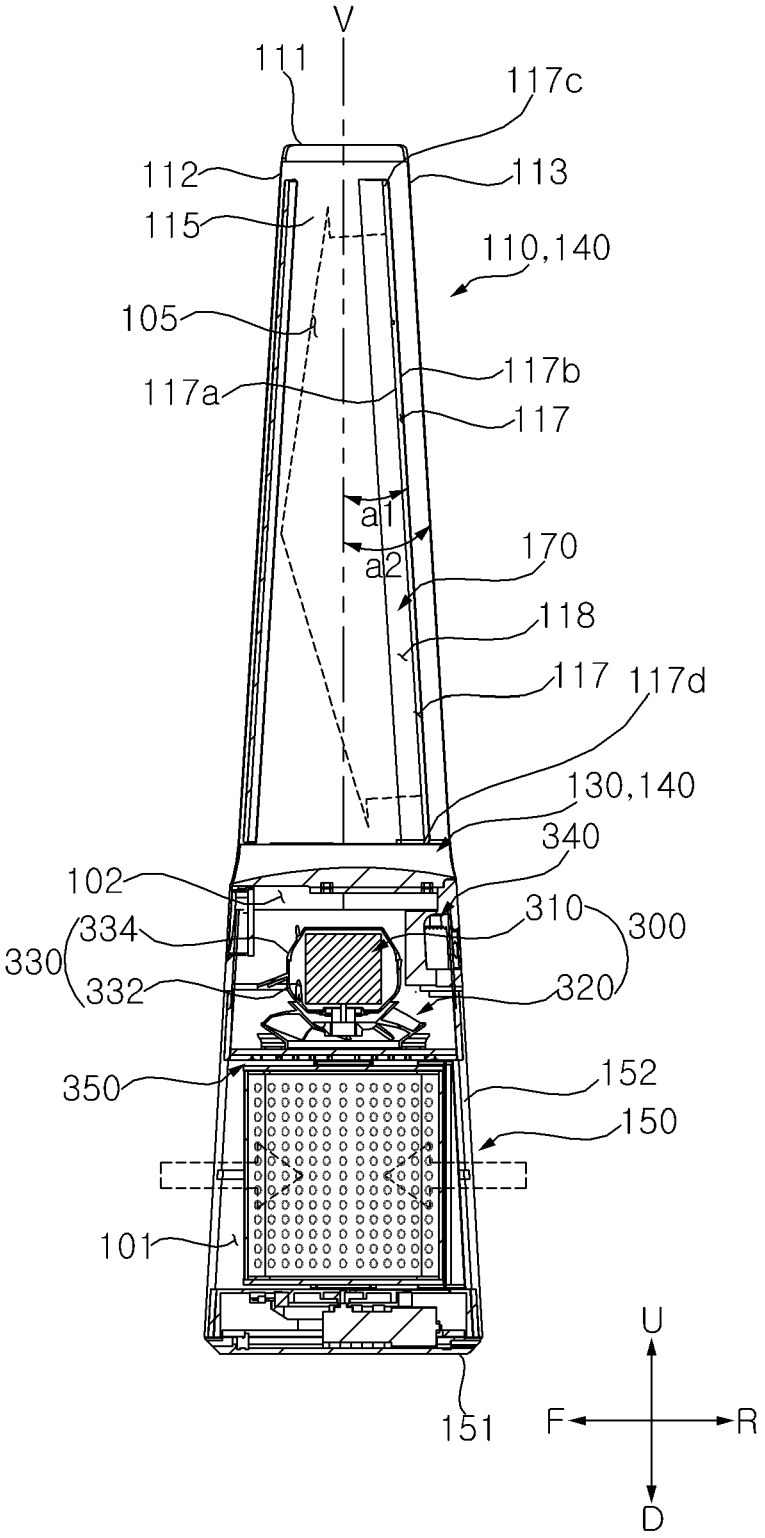
FIG. 5 is a cross-sectional view taken along line V-V of FIG. 3.
Figure 6:
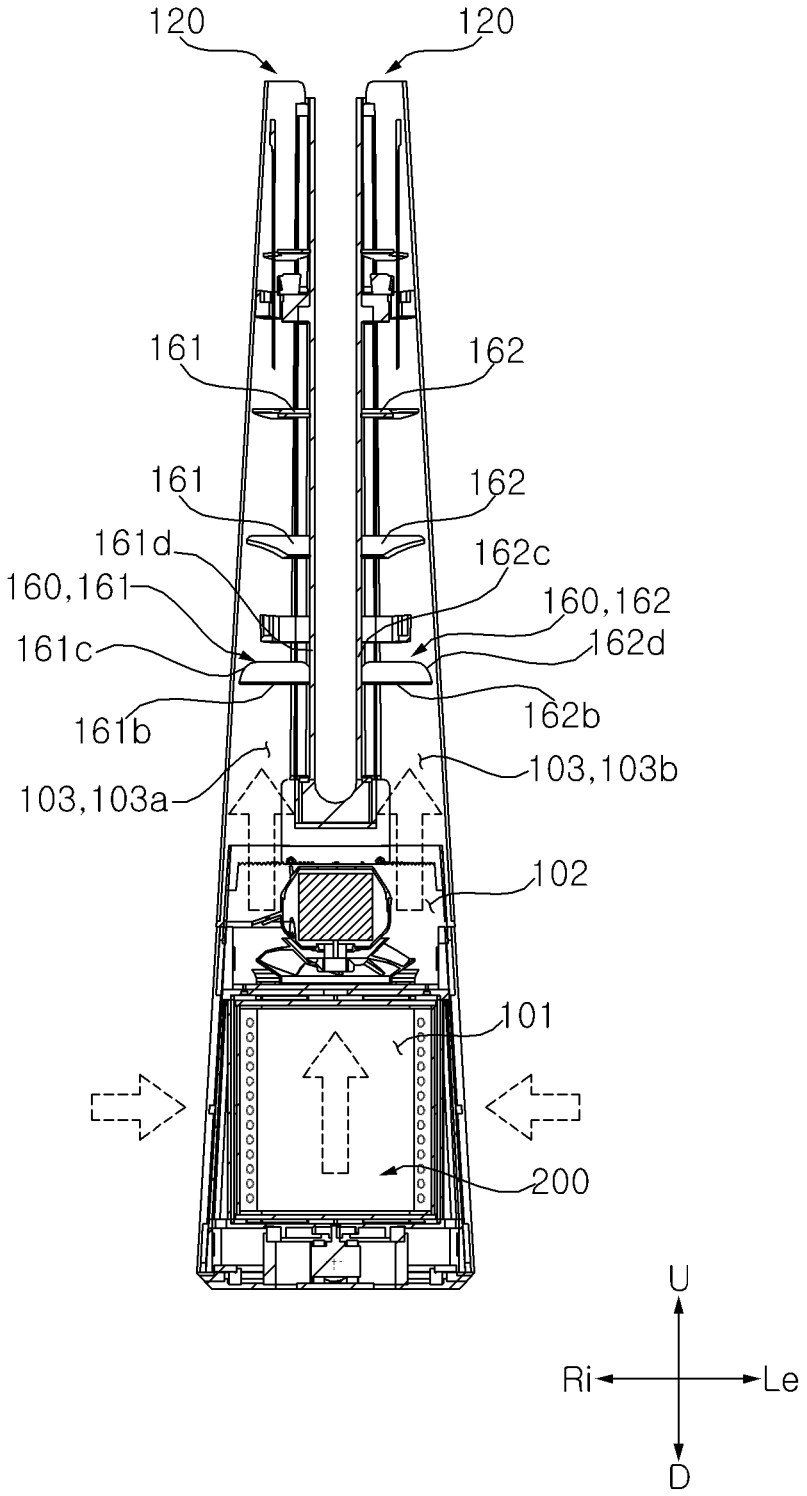
FIG. 6 is a cross-sectional view taken along line VI-VI of FIG. 4.
Figure 7:
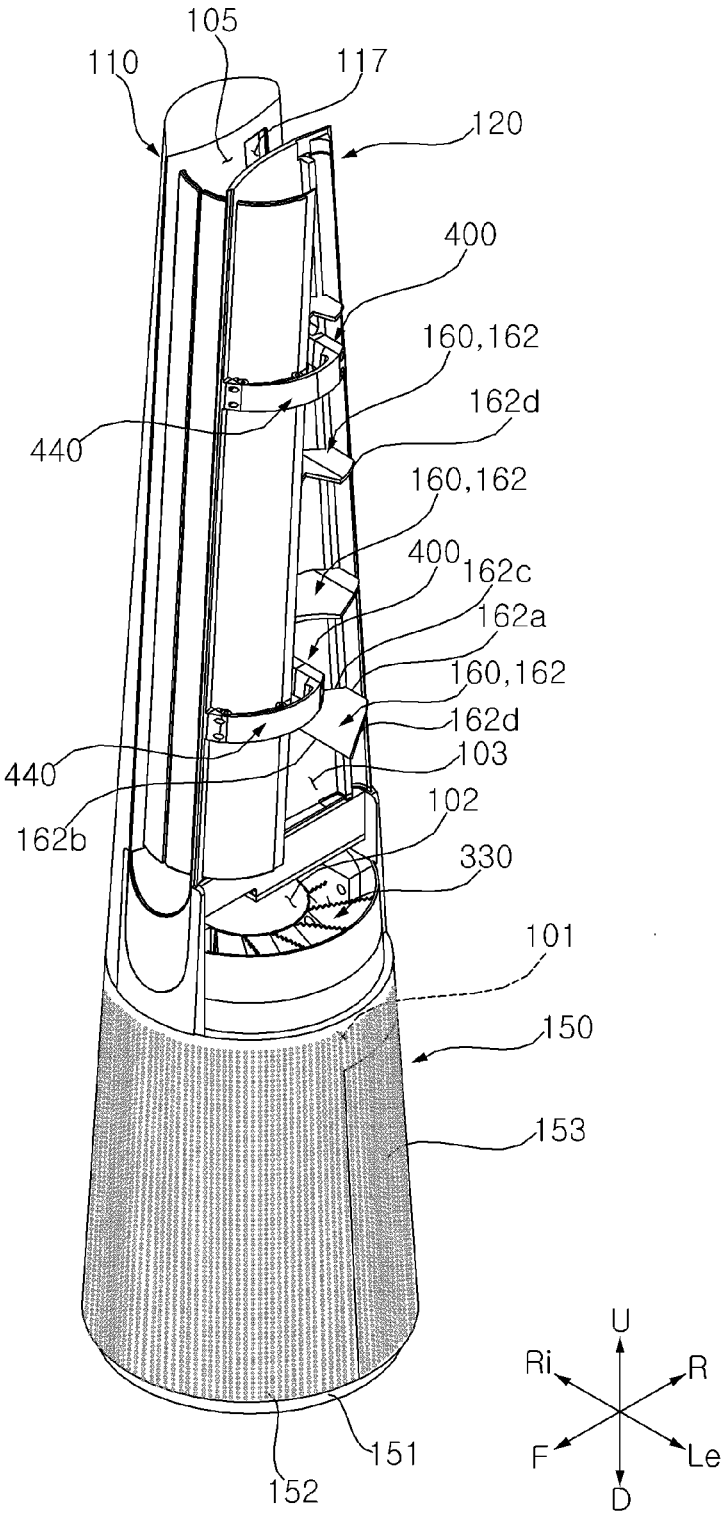
FIG. 7 is a partially exploded perspective view illustrating an interior of a second tower of FIG. 1.

Referring to FIGS. 1 and 5-6, the blower 1 may include a filter 200 provided inside the case 100 and a fan device 300 provided inside the case 100 to guide air to the discharge port 117, 127. The filter 200 and the fan device 300 may be provided inside the base case 150. The base case 150 may be formed in a truncated cone shape, and an upper side of the base case 150 may be opened.

Referring to FIG. 5, the base case 150 may include a base 151 seated on the ground and a base outer wall 152 that may be coupled to an upper side of the base 151. The base outer wall 152 may have a space formed therein and may have a suction port 155.

The base 151 may be formed in a circular shape. The base outer wall 152 may be formed in a truncated cone shape having open upper and lower sides. Referring to FIG. 2, a part of a side surface of the base outer wall 152 may be opened. An open portion of the base outer wall 152 may be referred to as a filter insertion port 154.

Referring to FIG. 2, the case 100 may include a cover 153 that blocks the filter insertion port 154. The cover 153 may be assembled to be detachable from the base outer 152 and the filter 200 may be held in or assembled to the cover 153. The user may separate the cover 153 and take the filter 200 out of the case 100 for cleaning, reparation, replacement, etc.

The suction port 155 may be formed in at least one of the base outer wall 152 and the cover 153. The suction port 155 may be formed in both the base outer wall 152 and the cover 153, and may suction air from all directions 360 around the case 100. The suction port 155 may be formed in a hole shape, and a shape and/or arrangement of the suction port 155 may be variously formed.

The filter 200 may be formed in a cylindrical shape having a vertical hollow space. The outer surface of the filter 200 may be provided to face the suction port 155 formed in the base outer wall 152 or the cover 153. The indoor or ambient air may pass through the filter 200 from an outside to an inside of the filter 200, and foreign substances or harmful gases in the air may be removed from the air.

The fan device 300 may be provided above the filter 200. The fan device 300 may guide the air that passed through the filter 200 to the first tower 110 and the second tower 120.

Referring to FIG. 5, the fan device 300 may include a fan motor 310 and a fan 320 rotated by the fan motor 310, and may be provided inside the base case 150.

The fan motor 310 may be provided above the fan 320, and a motor shaft of the fan motor 310 may be coupled to the fan 320 provided in the lower side. A motor housing 330 in which the fan motor 310 may be installed or located may be provided above the fan 320.

The motor housing 330 may have a shape surrounding the entire fan motor 310. Since the motor housing 330 surrounds the entire fan motor 310, a flow resistance of air flowing from a lower side to an upper side may be reduced. Alternatively, the motor housing 330 may be formed in a shape surrounding only a lower portion of the fan motor 310.

The motor housing 330 may include a lower motor housing 332 and an upper motor housing 334. At least one of the lower motor housing 332 or the upper motor housing 334 may be coupled to the case 100. After the fan motor 310 may be installed or provided in the upper side of the lower motor housing 332, the upper motor housing 334 may be covered to surround the fan motor 310. The motor shaft of the fan motor 310 may pass through the lower motor housing 332 and may be assembled to the fan 320.

The fan 320 may include a hub to which the shaft of the fan motor is coupled, a shroud spaced apart from the hub, and a plurality of blades connecting the hub and the shroud. After the air that passed through the filter 200 is suctioned into the shroud, the air may be pressurized and guided by a rotating blade. The hub may be provided at an upper side of the blade, and the shroud may be provided at a lower side of the blade. The hub may be formed in a bowl shape which has a curvature downward to be concave, and the lower side of the lower motor housing 332 may be partially inserted therein.

The fan 320 may be a mixed flow fan. The mixed flow fan may suction air into an axial center and discharges air in a radial direction. The discharged air may be formed to be inclined with respect to the axial direction. Since an entire air flow may flow from the lower side to the upper side, when air may be discharged in the radial direction like a general centrifugal fan, a large flow loss may occur due to a change of the flow direction. The mixed flow fan may reduce or minimize an air flow loss by discharging air upward in the radial direction.

A diffuser 340 may be further provided above the fan 320. The diffuser 340 may guide the air flow caused by the fan 320 in the upward direction. The diffuser 340 may further reduce a radial component of the air flow and enhance an upward air flow component.

The motor housing 330 may be provided between the diffuser 340 and the fan 320. To reduce or minimize a vertical installation height of the motor housing 330, a lower end of the motor housing 330 may be provided to be inserted into the fan 320 to overlap with the fan 320 in the vertical direction. An upper end of the motor housing 330 may be provided to be inserted into the diffuser 340 to overlap with the diffuser 340 in the vertical direction. The lower end of the motor housing 330 may be provided higher than the lower end of the fan 320, and the upper end of the motor housing 330 may be provided lower than the upper end of the diffuser 340.

To configure or optimize the installation position of the motor housing 330, the upper side of the motor housing 330 may be provided inside the tower base 130 and the lower side of the motor housing 330 may be provided inside the base case 150. The motor housing 330 may be provided inside the tower base 130 or the base case 150.

A suction grill 350 may be provided inside the base case 150. When the filter 200 may be separated, the suction grill 350 may block a user's finger from being caught in the fan 320 and may protect both the user and the fan 320.

The filter 200 may be provided at a lower side of the suction grill 350 and the fan 320 may be provided at an upper side. The suction grill 350 may have a plurality of through holes so that air may flow vertically.

A filter installation space 101 in which the filter 200 may be provided may be formed in a space of the case 100 below the suction grill 350. A flow space 102 through which air flows between the suction grill 350 and the discharge port 117, 127 may be formed inside the case 100.

Referring to FIG. 6, a discharge space 103 may be formed inside the first tower 110 and the second tower 120 to facilitate an upward air flow toward the first discharge port 117 and/or the second discharge port 127. The flow space 102 may include the discharge space 103. The ambient or indoor air may be introduced into the filter installation space 101 through the suction port 155 and then discharged to the discharge ports 117, 127 through the flow space 102 and the discharge space 103.

Referring to FIGS. 5 to 8, an air guide 160 to convert a flow direction of air toward a horizontal direction may be provided in the discharge space 103. A plurality of air guides 160 may be provided. The air guide 160 may guide air flowing in a vertical direction toward the discharge ports 117, 127 outward to flow in a horizontal direction. The air guide 160 may alternatively be referred to as a vane or louver.

The air guide 160 may include a first air guide 161 provided inside the first tower 110 and a second air guide 162 provided inside the second tower 120. Referring to FIG. 6, the first air guide 161 may be coupled to an inner wall and/or an outer wall of the first tower 110. The first air guide 161 may be provided such that a front side end 161*a* may be close to the first discharge port 117 and a rear side end 161*b* may be spaced apart from the rear end 113 of the first tower 110.

To guide the air flowing from the lower side to the first discharge port 117, the first air guide 161 may be formed to have a convex curved surface from a lower side to tan upper side. The rear side end 161*b* may be provided lower than the front side end 161*a*.

At least a portion of a left side end 161*c* of the first air guide 161 may be in close contact with or coupled to the left wall of the first tower 110. At least a portion of a right side end 161*d* of the first air guide 161 may be in close contact with or coupled to the right wall of the first tower 110. Air moving upward along the discharge space 103 may flow from the rear end of the first air guide 161 to the front end of the first air guide 161.

Figure 8:
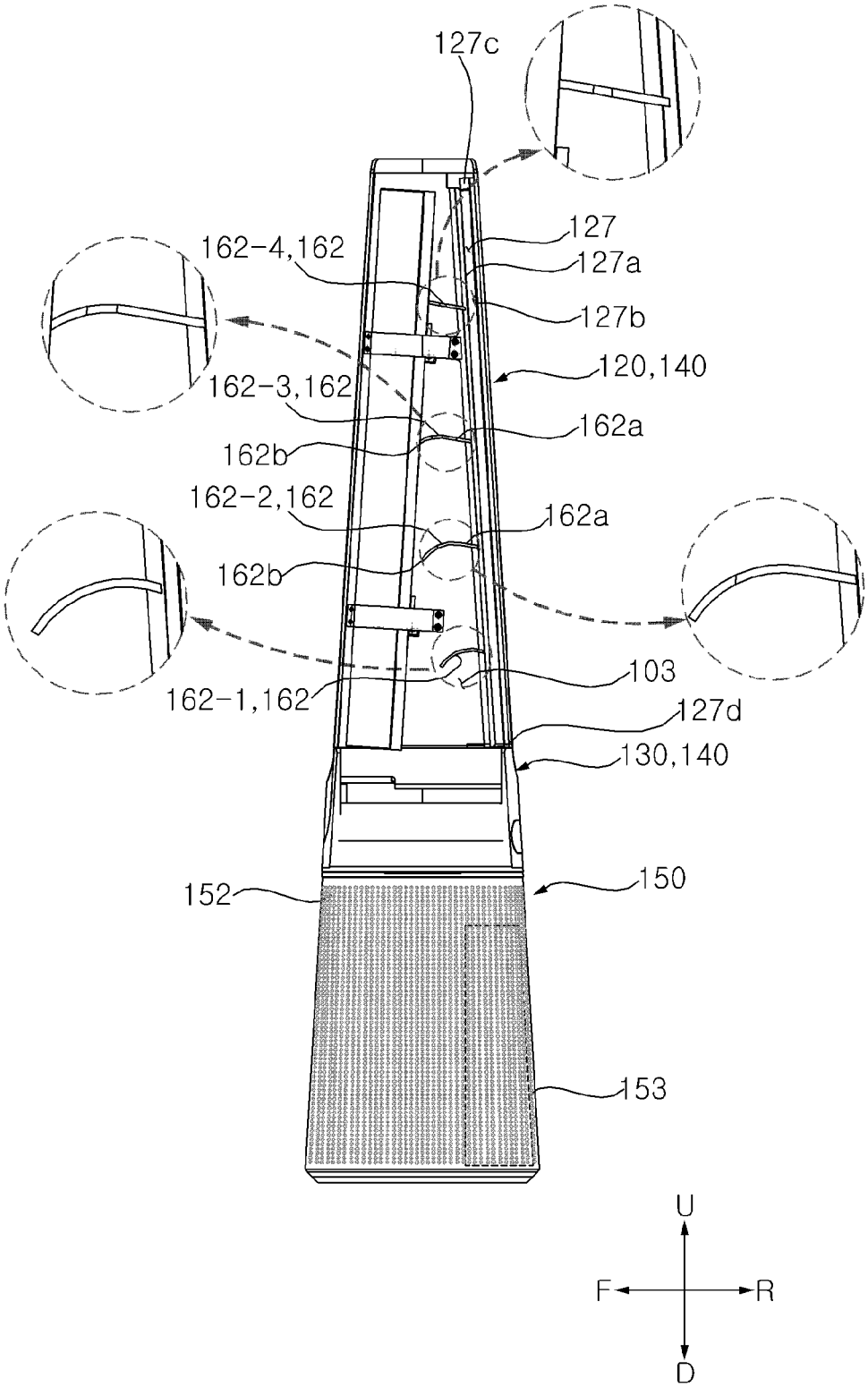
FIG. 8 is a right side view of FIG. 7.

The second air guide 162 may be vertically symmetrical to the first air guide 161. The second air guide 162 may be coupled to an inner wall and/or an outer wall of the second tower 110. Referring to FIG. 8, a front side end 162*a* of the second air guide 162 may be close to the second discharge port 127, and a rear side end 162*b* may be spaced apart from the rear end of the second tower 120.

To guide the air flowing from the lower side to the second discharge port 127, the second air guide 162 may be formed to have a convex curved surface from a lower side to an upper side. The rear side end 162*b* may be provided lower than the front side end 162*a*.

Referring back to FIG. 6, at least a portion of a left side end 162*c* of the second air guide 162 may be in close contact with or coupled to the left wall of the second tower 120. At least a portion of a right side end 162*d* of the second air guide 162 may be in close contact with or coupled to the right wall of the first tower 110.

Referring to FIGS. 5 and 8, the first discharge port 117 and the second discharge port 127 may extend in the vertical direction. The first discharge port 117 may be provided between the front end 112 and the rear end 113 of the first tower 110 at a position closer to the rear end 113 than the front end 112. The air discharged from the first discharge port 117 may flow along the first inner wall 115 due to the Coanda effect. The air flowing along the first inner wall 115 may flow toward the front end 112.

Referring to FIG. 5, the first discharge port 117 may include a first border or edge 117*a* forming an edge of an air discharge side (a front end in FIG. 5), a second border or edge 117*b* forming an edge of an opposite side (a rear end in FIG. 5) to the air discharge side, an upper border or edge 117*c* forming an upper edge of the first discharge port 117, and a lower border or edge 117*d* forming a lower edge of the first discharge port 117. The first border 117*a* and the second border 117*b* may be parallel to each other. The upper border 117*c* and the lower border 117*d* may be parallel to each other.

The first border 117*a* and the second border 117*b* may be inclined with respect to the vertical direction V. The rear end 113 of the first tower 110 may be also provided to be inclined with respect to the vertical direction V.

The inclination a1 of the discharge port 117 may be greater than the inclination a2 of the outer surface of the tower 110. Referring to FIG. 5, the inclination a1 of the first border 117*a* and the second border 117*b* with respect to the vertical direction V may be formed to be 4 degrees, and the inclination a2 of the rear end 113 may be formed to be 3 degrees. As an alternative, the inclinations a1 and a2 may be the same. The second discharge port 127 may be formed to be vertically symmetrical with the first discharge port 117.

Referring to FIG. 8, the second discharge port 127 may include a first border or edge 127*a* forming an edge of the air discharge side (a front end in FIG. 8), a second border or edge 127*b* forming an edge of the opposite side (a rear end in FIG. 8) to the air discharge side, an upper border or edge 127*c* forming an upper edge of the second discharge port 127, and a lower border or edge 127*d* forming a lower edge of the second discharge port 127.

Figure 9:
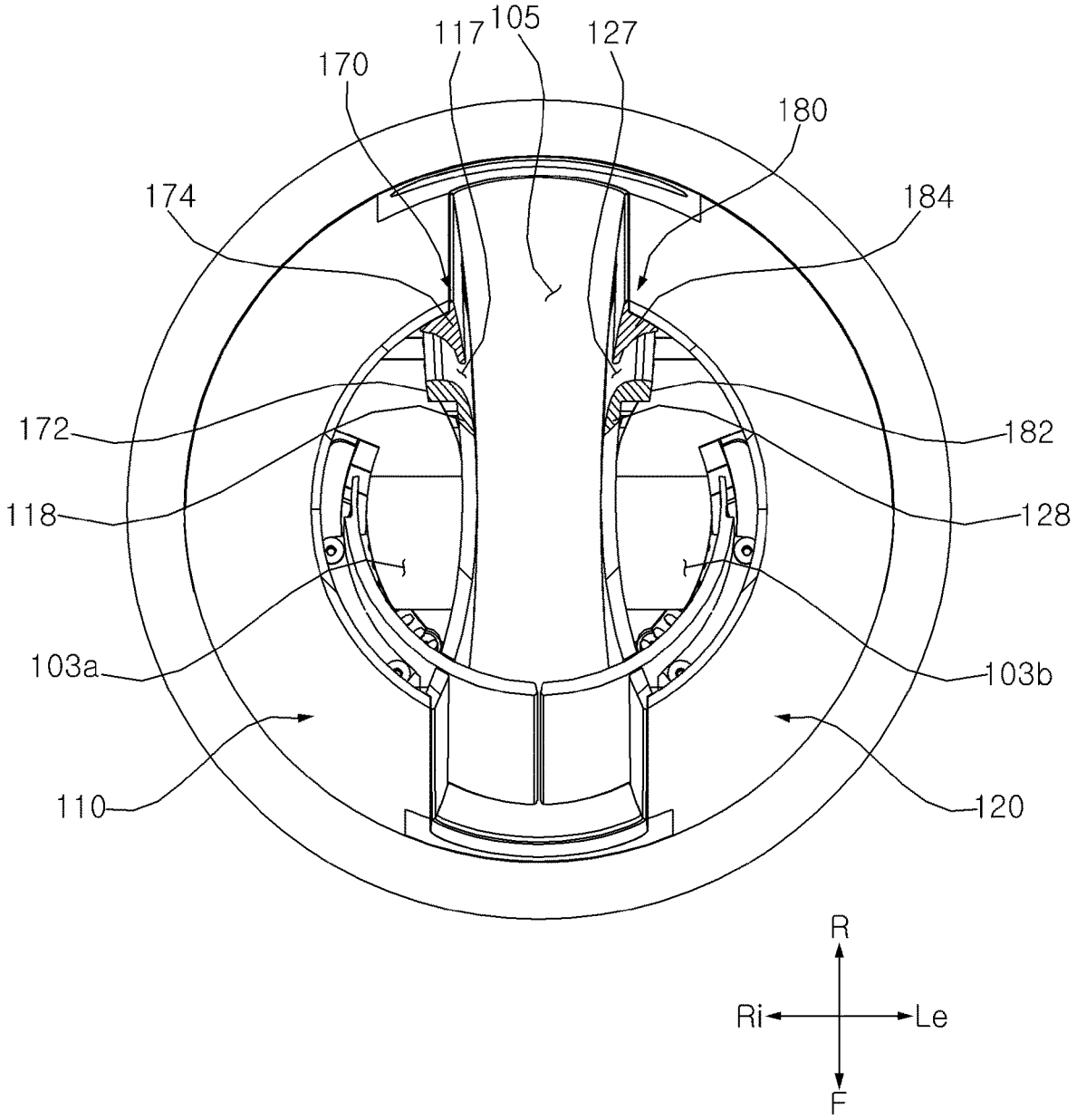
FIG. 9 is a cross-sectional view taken along line IX-IX of FIG. 3.

Referring to FIG. 9, the first discharge port 117 of the first tower 110 may face the second tower 120, and the second discharge port 127 of the second tower 120 may face the first tower 110. The air discharged from the first discharge port 117 may flow along the inner wall 115 of the first tower 110 through the Coanda effect. The air discharged from the second discharge port 127 flows along the inner wall 125 of the second tower 120 through the Coanda effect.

The blower 1 further may include a first discharge case 170 and a second discharge case 180. The first discharge port 117 may be formed in the first discharge case 170. The first discharge case 170 may be assembled or coupled to the first tower 110. The second discharge port 127 may be formed in the second discharge case 180. The second discharge case 180 may be assembled or coupled to the second tower 120.

The first discharge case 170 may be installed to penetrate the inner wall 115 of the first tower 110 and/or to be provided between the inner and outer walls 115 and 114 of the first tower 110. The second discharge case 180 may be installed to penetrate the inner wall 125 of the second tower 120 and/or to be provided between the inner and outer walls 125 and 124 of the second tower 120. The first discharge case 170 may have a first discharge opening 118 for the first tower 110, and the second discharge case 180 may have a second discharge opening 128 for the second tower 120.

The first discharge case 170 may include a first discharge guide 172 and second discharge guide 174 which form the first discharge port 117. The first discharge guide 172 may be provided at an air discharge side of the first discharge port 117. The second discharge guide 174 may be provided at an opposite side of the air discharge side of the first discharge port 117.

Figure 10:
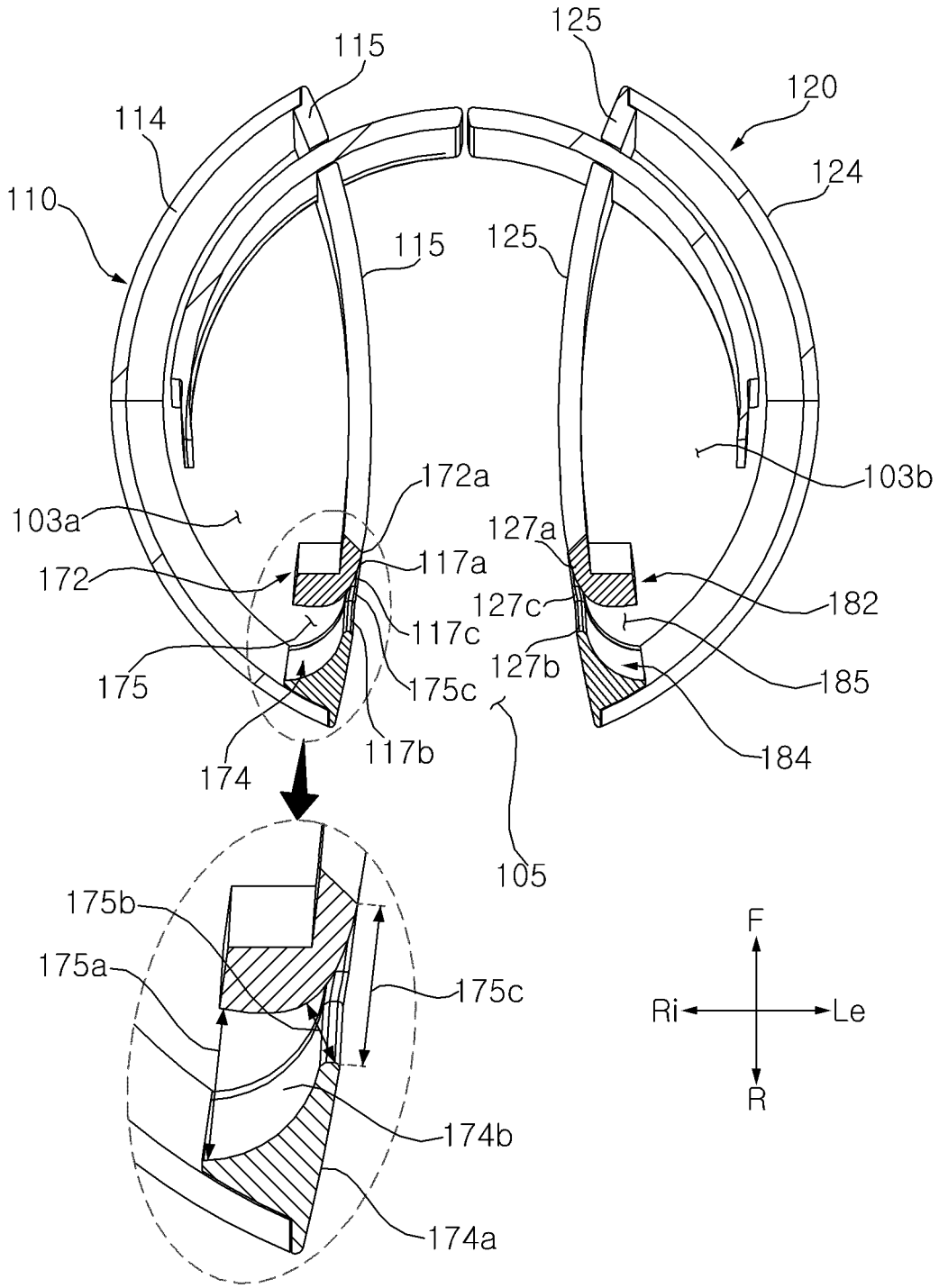
FIG. 10 is a cross-sectional view taken along line X-X in FIG. 3.

Referring to FIG. 10, outer surfaces 172*a* and 174*a* of the first discharge guide 172 and the second discharge guide 174 may define a portion of the inner wall 115 of the first tower 110. An inner side of the first discharge guide 172 may face the first discharge space 103*a*, and an outer side of the first discharge guide 172 may face the blowing space 105. An inner side of the second discharge guide 174 may face the first discharge space 103*a*, and an outer side of the second discharge guide 174 may face the blowing space 105.

The outer surface 172*a* of the first discharge guide 172 may be formed in a curved surface to provide a surface continuous to an outer surface of the first inner wall 115. The outer surface 174*a* of the second discharge guide 174 may provide a surface continuous to the first inner wall 115. The inner surface 174*b* of the second discharge guide 174 may be formed as a curved surface continuous to the inner surface of the first outer wall 115 and guide the air in the first discharge space 103*a* into the blowing space 105 with the first discharge guide 172. The first discharge port 117 may be formed between the first discharge guide 172 and the second discharge guide 174, and the air in the first discharge space 103*a* may be discharged to the blowing space 105 through the first discharge port 117.

The air in the first discharge space 103*a* may be discharged between the outer surface 172*a* of the first discharge guide 172 and the inner surface 174*b* of the second discharge guide 174. A discharge channel 175 through which air may be discharged may be formed between the outer surface 172*a* of the first discharge guide 172 and the inner surface 174*b* of the second discharge guide 174.

In the discharge channel 175, a width of a middle portion 175*b* may be formed narrower in comparison with an inlet 175*a* and an outlet 175*c*. At the middle portion 175*b*, a distance between the second border 117*b* and the outer surface 172*a* of the first discharge guide 172 may be shortest.

Referring to FIG. 10, a cross-sectional area may gradually narrow from the inlet of the discharge channel 175 to the middle portion 175*b*, and to cross-sectional area may be widened again from the middle portion 175*b* to the outlet 175*c*. The middle portion 175*b* may be located inside the first tower 110. When viewed from the outside, the outlet 175*c* of the discharge channel 175 may be seen as the discharge port 117.

To induce the Coanda effect, a radius of curvature of the inner surface 174*b* of the second discharge guide 174 may be formed to be larger than a radius of curvature of the outer surface 172*a* of the first discharge guide 172. A center of curvature of the outer surface 172*a* of the first discharge guide 172 may be located in front of the outer surface 172*a* and may be formed inside the first discharge space 103*a*. A center of curvature of the inner surface 174*b* of the second discharge guide 174 may be located in the first discharge guide 172 side and may be formed inside the first discharge space 103*a*.

Referring to FIG. 10, the second discharge case 180 may include a first discharge guide 182 and a second discharge guide 184 which form the second discharge port 127. The first discharge guide 182 may be provided at an air discharge side of the second discharge port 127, and the second discharge guide 184 may be provided at an opposite side of the air discharge side of the second discharge port 127. A discharge channel 185 may be formed between the first discharge guide 182 and the second discharge guide 184. Since the second discharge case 180 may be vertically symmetrical with the first discharge case 170, a detailed description will be omitted.

Referring to FIGS. 4, 9, 10, and 18, an airflow width due to the Coanda effect will be described in more detail. Referring to FIG. 4, the air discharged from the first discharge port 117 may flow to the first front end 112 along the first inner surface 115, and the air discharged from the second discharge port 127 may flow to the second front end 122 along the second inner surface 125.

The center distance B0 of the first inner wall 115 and the second inner wall 125 may be configured or predetermined to facilitate an intensive discharge of air forward through the Coanda effect. As the center distance B0 may be increased, the Coanda effect may become weaker, but the blowing space 105 may be wider. As the center distance B0 may be decreased, the Coanda effect may become stronger, but the blowing space 105 may be narrower.

The center distance B0 may range from 20 millimeters (mm) to 30 mm. An airflow width (left and right width) of 1.2 meters (m) may be maintained at a distance of 1.5 m in front of the front end 112, 122. A discharge angle A of the first inner wall 115 and the second inner wall 125 may be designed to limit a left-right diffusion range of discharge air. Referring briefly to FIG. 4, the discharge angle A may be defined as an angle between the center line L-L' and a tangent line formed at the front end 112, 122 of the inner wall 115, 125.

As the discharge angle A becomes smaller, the airflow width (in the left and right direction) of the discharged air becomes narrow. As the discharge angle A becomes larger, the airflow width of the discharged air becomes wider. The discharge angle A may range from 11.5 degrees to 30 degrees. When the discharge angle A is less than 11.5 degrees, the airflow width of the discharge air may be very narrow, and when the discharge angle A exceeds 30 degrees, forming a concentrated airflow in a discharge area may be difficult.

The blower 1 may further include an air flow guide or converter 400 that converts an air flow direction of the air in the blowing space 105. The air flow converter 400 may convert a horizontal airflow flowing through the blowing space 105 into an upward airflow. The air flow converter 400 may serve as a damper.

Figure 11:
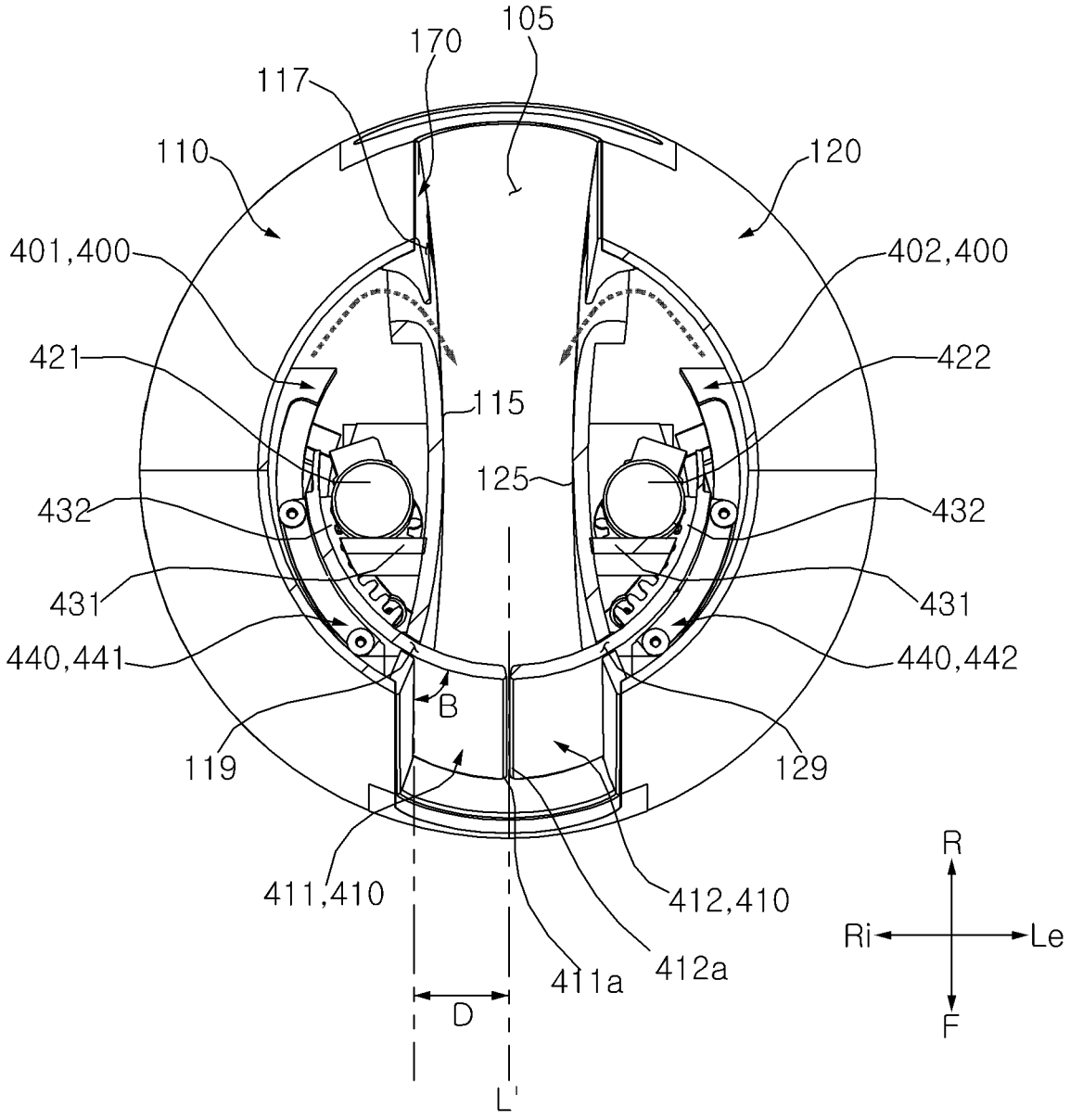
FIG. 11 is a cross-sectional view taken along XI-XI of FIG. 3.
Figure 12:
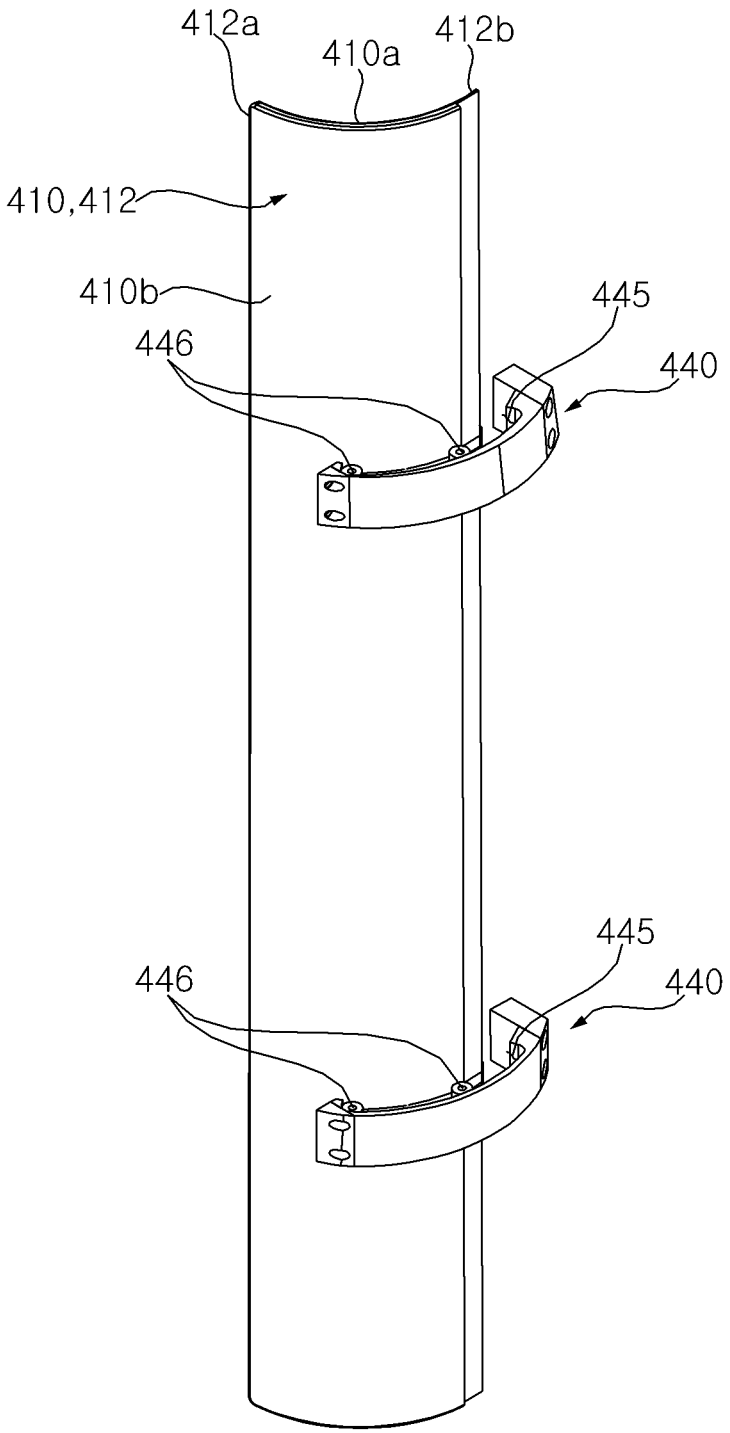
FIG. 12 is a perspective view of an air flow converter shown in FIG. 7.

Referring to FIG. 11, the air flow converter 400 may include a first air flow converter 401 provided in the first tower 110 and a second air flow converter 402 provided in the second tower 120. The first air flow converter 401 and the second air flow converter 402 may be vertically symmetrical and may have the same or a similar configuration.

The air flow guide 400 may include an air flow gate 410. The air flow gate 410 may a vertically oriented louver or a board, and may be referred to simply as a gate. The gate 410 may include a first gate 411 for the first air flow converter 401 and a second gate 412 for the second air flow converter 402. The gate 410 may be provided in the tower 110, 120. The gate 410 may be moved to protrude into the blowing space 105 to close a front opening of the blowing space 105 and guide airflow upward.

To move the gate 410, the air flow converter 400 may include a guide motor 420 which provides a driving force for a movement of the gate 410, a gear device or gear 430 which provides a driving force of the guide motor 420 to the gate 410, and a board or gate guider or guide 440 which may be provided inside the tower 110, 120 and guide the movement of the gate 410. The gate 410 may be concealed or inserted inside the tower 110, 120 and/or may be withdrawn to protrude into the blowing space 105, depending on a movement and setting of the gate 410.

The air flowing through the blowing space 105 may flow from the first discharge port 117 or the second discharge port 127 to the front of the blowing space 105. The gate 410 may be provided downstream of the first discharge port 117 and the second discharge port 127 with respect to air flowing through the blowing space 105.

The first gate 411 may be provided inside the first tower 110 and may selectively protrude to the blowing space 105. The second gate 412 may be provided inside the second tower 120 and may selectively protrude to the blowing space 105.

A first board slit 119 may be formed in the inner wall 115 of the first tower 110 and a second board slit 129 may be formed in the inner wall 125 of the second tower 120. The first board slit 119 and the second board slit 129 may be provided to be vertically symmetrical. The first board slit 119 and the second board slit 129 may be formed to extend long in the vertical direction. The first board slit 119 and the second board slit 129 may be provided to be inclined with respect to the vertical direction V.

The inner end 411*a* of the first gate 411 may be exposed to the first board slit 119, and the inner end 412*a* of the second gate 412 may be exposed to the second board slit 129. When the first gate 411 may be provided inside the first tower 110, the inner end 411*a* of the first gate 411 may be provided not to protrude from the inner wall 115. When the second gate 412 may be provided inside the second tower 120, the inner end 412*a* of the second gate 412 may be provided not to protrude from the inner wall 115. The front of the blowing space 105 may be opened, and air may flow horizontally in a front-rear direction when the first and second gates 411 and 412 do not protrude into the blowing space 105.

Each of the first board slit 119 and the second board slit 129 may be provided to be more inclined than the front end 112 of the first tower 110 or the front end 122 of the second tower 120 based on the vertical direction. For example, the front end 112 of the first tower 110 may be formed with an inclination of 3 degrees, and the first board slit 119 may be formed with an inclination of 4 degrees. Similarly, the front end 122 of the second tower 120 may be formed with an inclination of 3 degrees, and the second board slit 129 may be formed with an inclination of 4 degrees.

The first gate 411 may be parallel to the first board slit 119, and the second gate 412 may be parallel to the second board slit 129. The gate 410 may be formed in a flat or curved plate or board shape. The gate 410 may extend in the vertical direction and may be provided in front of the blowing space 105 when protruded into the blowing space 105.

When moved into the blowing space 105, the gate 410 may block a horizontal airflow flowing to the blowing space 105, and the air may be guided upward. The inner end 411*a* of the first gate 411 and the inner end 412*a* of the second gate 412 may be in contact with or close to each other to guide an upward airflow. Alternatively, there may be only one gate 410 that moves toward an opposite tower 110 or 120 to contact the tower 110 or 120 to block a front of the blowing space and facilitate an upward airflow.

Figure 16:
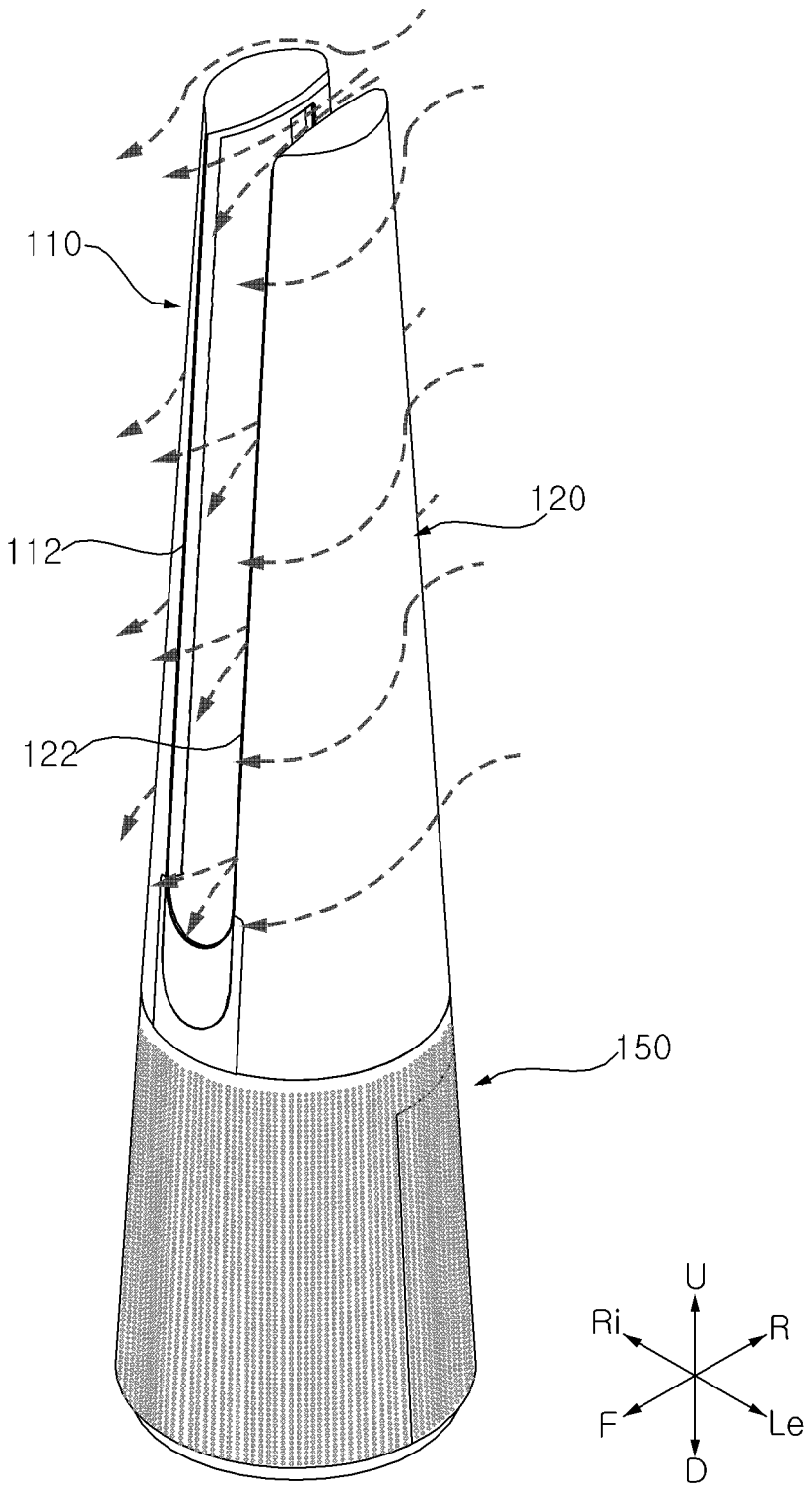
FIG. 16 is an exemplary view illustrating a horizontal airflow of a blower according to the first embodiment.

Referring to FIG. 16, during a horizontal airflow, the inner end 411*a* of the first gate 411 may close the first board slit 119, and the inner end 412*a* of the second gate 412 may close the second board slit 129. The first and second gates 411 and 412 may be concealed to be inside of the first and second towers 110 and 120, respectively.

Figure 17:
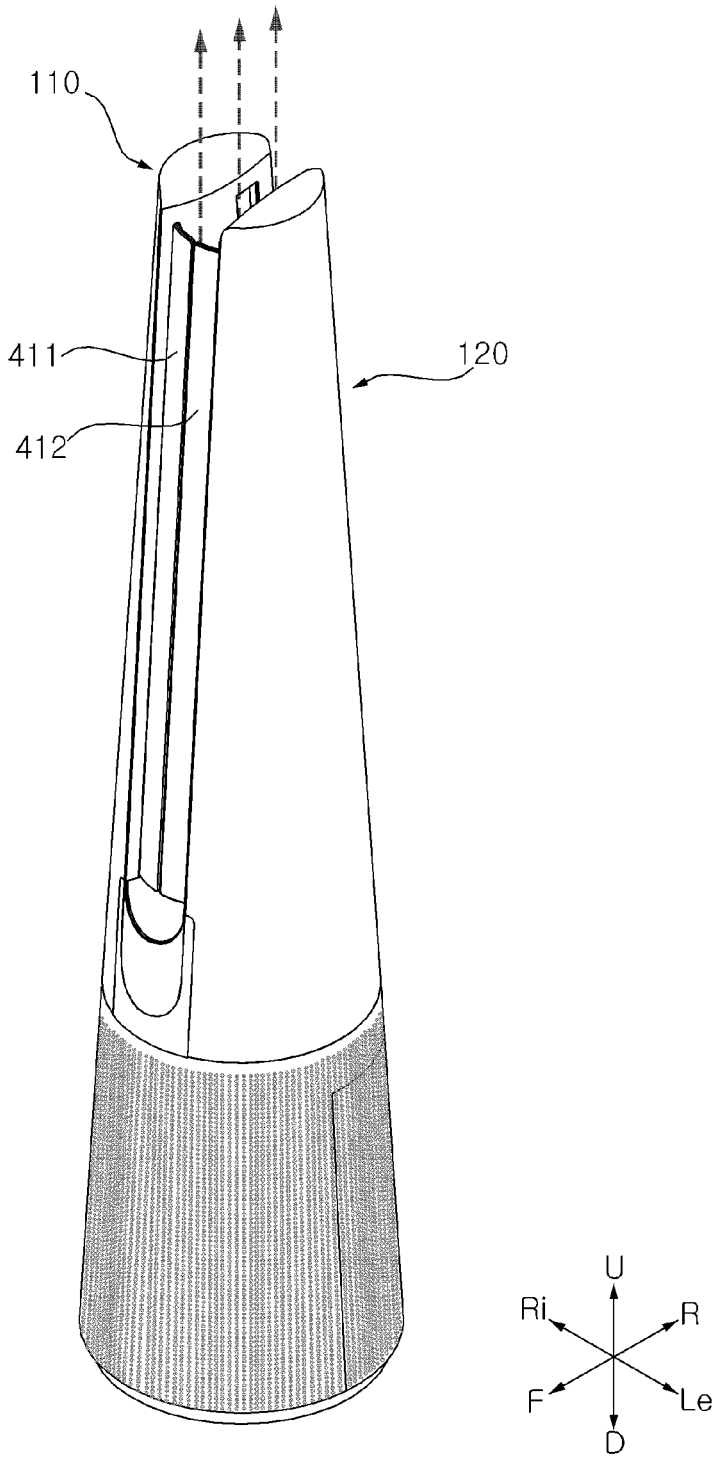
FIG. 17 is an exemplary view illustrating an upward airflow of a blower according to the first embodiment.

Referring to FIG. 17, when the inner end 411*a* of the first gate 411 passes through the first board slit 119 and protrudes to the blowing space 105, and the inner end 412*a* of the second gate 412 passes through the second board slit 129 and protrudes to the blowing space 105, the front of the blowing space 105 may be blocked, and air may be guided upward.

As the first gate 411 closes the first board slit 119, air in the first discharge space 103*a* may be prevented from leaking or flowing into the first board slit 119. As the second gate 412 closes the second board slit 129, air in the second discharge space 103*b* may be prevented from leaking or flowing into the second board slit 129.

The first gate 411 and the second gate 412 may protrude to the blowing space 105 by a rotating operation. Alternatively, at least one of the first gate 411 and the second gate 412 may linearly move in a slide manner to protrude to the blowing space 105.

Referring to FIG. 11, the first gate 411 and the second gate 412 may be formed in an arc shape. The first gate 411 and the second gate 412 may form a certain radius of curvature, and a center of curvature may be provided in the blowing space 105.

Figure 14:
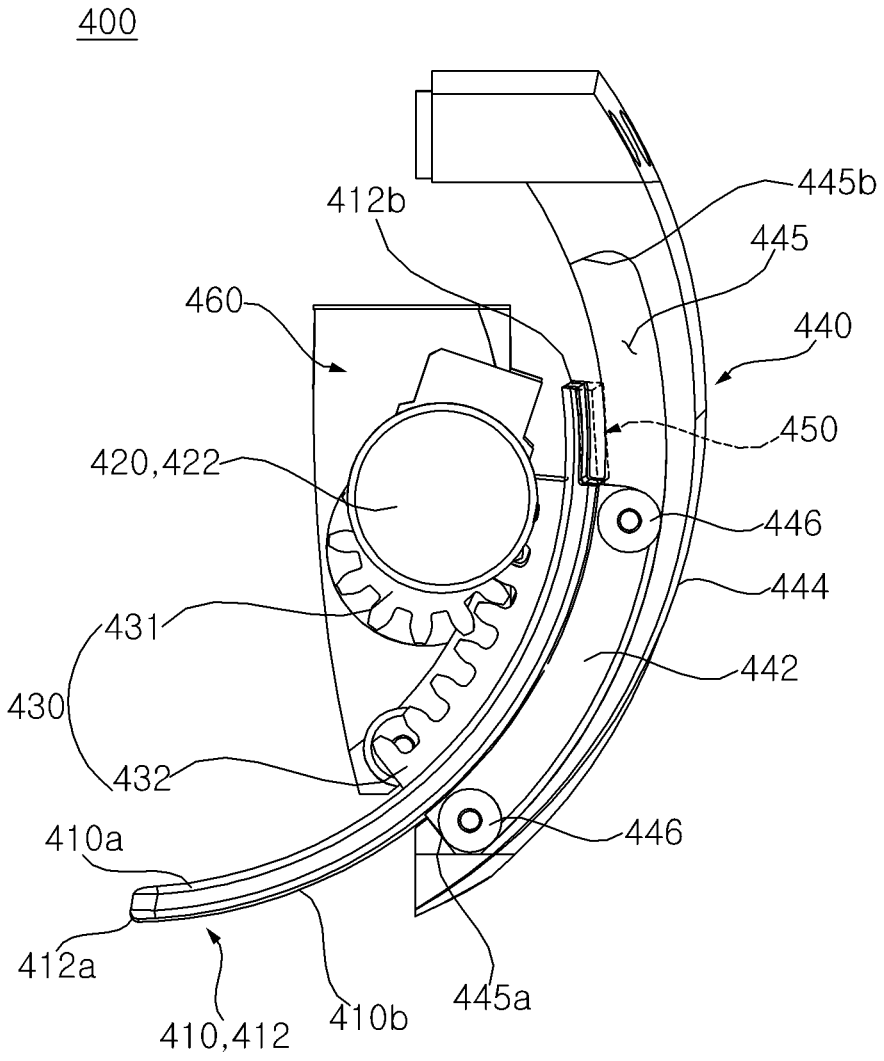
FIG. 14 is a plan view of FIG. 12.
Figure 15:
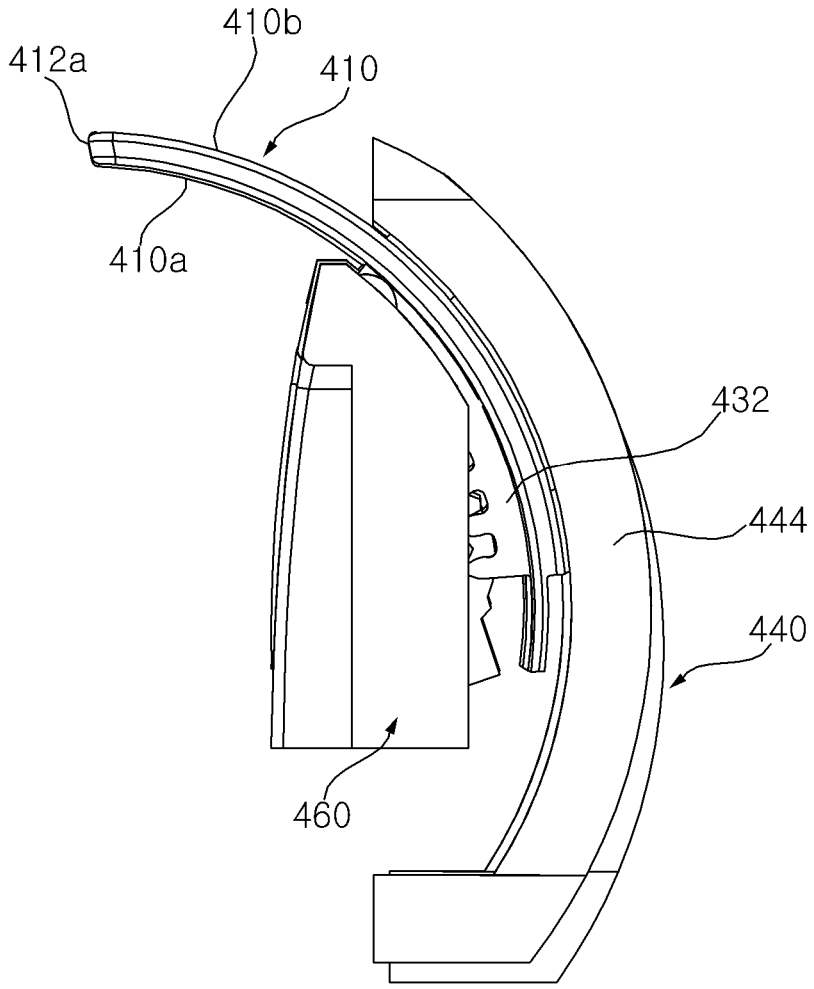
FIG. 15 is a bottom view of FIG. 12.

The gate 410 may be formed of a transparent material. Referring to FIG. 14, a light emitting member 450 such as a light emitting diode (LED) may be provided in the gate 410, and the entire gate 410 may be lit up through light generated from the light emitting member 450. The light emitting member 450 may be provided in the outer end 412*b* of the gate 410 to be in the discharge space 103 inside the tower 110 and 120. A plurality of light emitting members 450 may be provided along a length direction of the gate 410.

Referring back to FIG. 11, the guide motor 420 may include a first guide motor 421 providing rotational force to the first gate 411 and a second guide motor 422 providing rotational force to the second gate 412.

Figure 13:
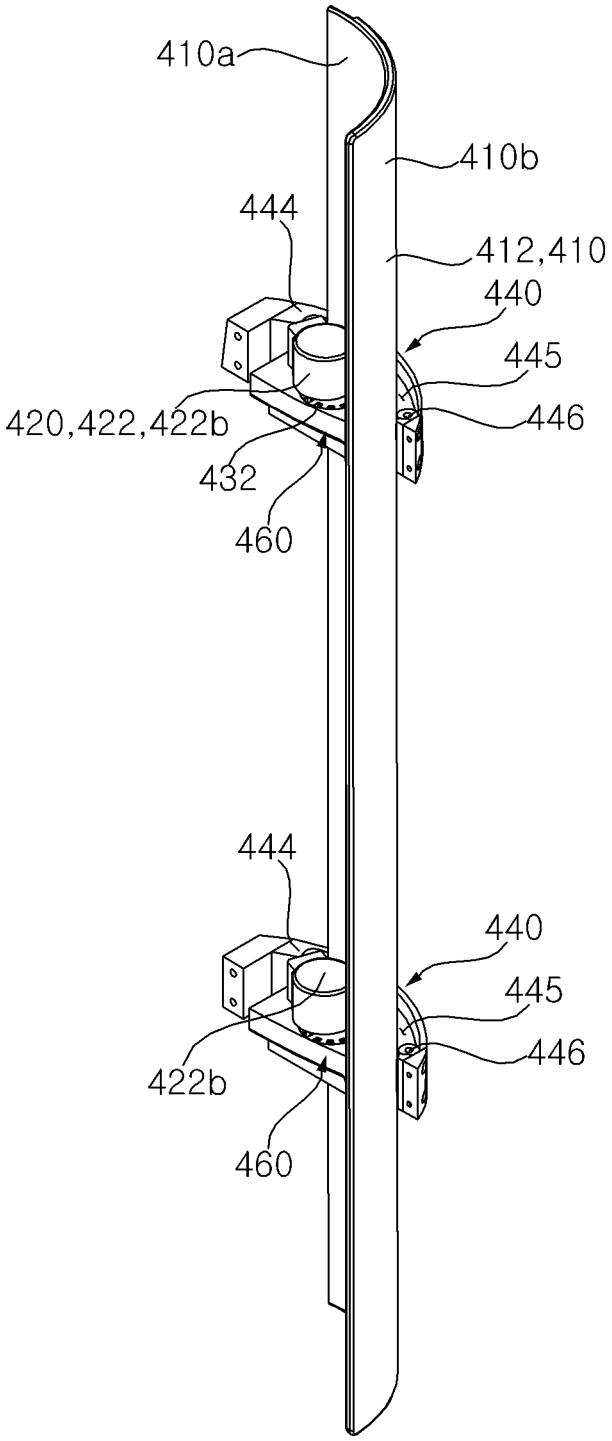
FIG. 13 is a perspective view of an air flow converter viewed from the opposite side of FIG. 12.

Referring to FIG. 13, the second guide motor 422 may include an upper second guide motor 422*a* provided at an upper portion of the second gate 412, and a lower second guide motor 422*b* provided at a lower portion of the second gate 412. Similarly, the first guide motor 421 may include an upper first guide motor 421 and a lower first guide motor 421. Rotation shafts of the first guide motor 421 and the second guide motor 422 may be provided in a vertical direction, and a rack-pinion structure may be used to transmit the driving force.

Referring to FIG. 14, the gear device 430 may include a driving gear 431 coupled to a motor shaft of the guide motor 420 and a rack 432 coupled to the gate 410. The driving gear 431 may be a pinion gear and may be rotated.

The rack 432 may be coupled to the inner surface of the gate 410. The rack 432 may be formed in a shape corresponding to the gate 410 (e.g., an arc shape). Teeth of the rack 432 may extend toward the inner wall of the tower 110 or 120. The rack 432 may be provided in the discharge space 103 and may be rotated together with the gate 410.

Hereinafter, the gate guider 440 will be described with reference to FIGS. 12 to 15. Referring to FIGS. 12-15, the gate guider 440 as shown may be provided in the second tower 120, but a same description may be applied to the gate guider 440 provided in the first tower 110. The gate guider 440 may be classified into a first gate guider provided in the first tower 110 and a second gate guider provided in the second tower 120. A configuration of the gate guider 440 described below may apply to both "a first gate guider 440 provided in the first tower 110 and "a second" board guide 440 provided in the second tower 120.

The gate guider 440 may guide a turning movement of and support the gate 410. Referring to FIG. 14, the board guide 440 may be provided at an opposite side of the rack 432 based on the gate 410. The gate guider 440 may support a force applied from the rack 432. Alternatively, a groove corresponding to a turning radius of the gate 410 may be formed in the board guide 440, and the gate 510 may be moved along the groove.

The gate guider 440 may be assembled or coupled to the outer wall 114 and 124 of the tower 110, 120. The gate guider 440 may be provided at an outside in a radial direction based on the gate 410, thereby reducing or minimizing contact with air flowing through the discharge space 103.

The gate guider 440 may include a movement guider 442, a fixed guider 444, and a friction reducing member 446. The movement guider 442 may be coupled to a structure that moves together with the gate 410. The movement guider 442 may be coupled to the rack 432 or the gate 410 and may be rotated together with the rack 432 or the gate 410.

The movement guider 442 may be provided at an outer surface 410*b* of the gate 410. The movement guider 442 may be formed in an arc shape and may have a same center of curvature as the gate 410. A length of the movement guider 442 may be formed to be shorter than a length of the gate 410.

The movement guider 442 may be provided between the gate 410 and the fixed guider 444. A radius of the movement guider 442 may be larger than a radius of the gate 410 and smaller than a radius of the fixed guider 444. The movement guider 442 may be in contact with the fixed guider 444 to limit movement.

The fixed guider 444 may be provided in the outside in a radial direction in comparison with the movement guider 442 and may support the movement guider 442. A guide groove 445 in which the movement guider 442 may be provided may be formed in the fixed guider 444. The guide groove 445 may be formed in correspondence with the rotation radius and curvature of the movement guider 442.

The guide groove 445 may be formed in an arc shape, and at least a part of the movement guider 442 may be inserted into the guide groove 445. The guide groove 445 may be formed to be concave in the downward direction. The movement guider 442 may move along the guide groove 445.

A front end 445*a* of the guide groove 445 may limit movement of the movement guider 442 in one direction (a direction protruding to the blowing space 105). A rear end 445*b* of the guide groove 445 may limit movement of the movement guider 442 in the other direction (a direction withdrawing inside the tower 110, 120).

The friction reducing member 446 may reduce friction between the movement guider 442 and the fixed guider 444. The friction reducing member 446 may be a roller to provide a rolling friction or movement between the movement guider 442 and the fixed guider 444. A shaft of the roller of the friction reducing member 446 may be formed in the vertical direction. The friction reducing member 446 may be coupled to the movement guider 442. The friction reducing member 446 may reduce friction and operating noise. At least a portion of the friction reducing member 446 may be provided to protrude to an outside in a radial direction in comparison with the movement guider 442.

The friction reducing member 446 may be formed of an elastic material and may be elastically supported by the fixed guider 444 in the radial direction. The friction reducing member 446 may contact the front end 445*a* or the rear end 445*b* of the guide groove 445.

The blower 1 may further include a motor mount 460 to support the guide motor 420 and fixing the guide motor 420 to the tower. Referring to FIG. 13, the motor mount 460 may be provided in a lower portion of the guide motor 420 and support the guide motor 420. The guide motor 420 may be assembled or coupled to the motor mount 460.

The motor mount 460 may be coupled to the inner wall 115, 125 of the tower 110, 120. The motor mount 460 may be manufactured integrally with the inner wall 115, 125.

Hereinafter, a disposition of the blower 1 and a flow of air in the horizontal and upward directions be described with reference to FIGS. 16 and 17. Referring to FIG. 16, when facilitating a horizontal airflow, the first gate 411 may be concealed or or inserted inside the first tower 110, and the second gate 412 may be concealed or inserted inside the second tower 120.

The discharged air from the first discharge port 117 and the discharged air from the second discharge port 127 may be joined in the blowing space 120 and pass through the front end 112, 122 to flow forward. The air in the rear side of the blowing space 105 may be guided forward. In addition, the ambient or nearby air around the first tower 110 may flow forward along the first outer wall 114, and the ambient or nearby air around the second tower 120 may flow forward along the second outer wall 124.

Since the first discharge port 117 and the second discharge port 127 may extend in the vertical direction and be vertically symmetrical, the air flowing in the upper side of the first discharge port 117 and the second discharge port 127 and the air flowing in the lower side may have a similar or uniform flow. The air discharged from the first discharge port 117 and the second discharge port 127 may be joined in the blowing space 105, thereby improving a straightness or streamlining of the discharged air and allowing the air to flow farther away from the blower 1.

Referring to FIG. 17, when facilitating an upward airflow, the first gate 411 and the second gate 412 may protrude in to the blowing space 105 and block the front of the blowing space 105. The inner end 411*a* of the first gate 411 and the inner end 412*a* of the second gate 412 may be in close contact with each other or may be slightly spaced apart.

As the front of the blowing space 105 may be blocked by the first gate 411 and the second gate 412, the air discharged from the discharge port 117, 127 may rise along a rear surface of the gates 411 and 412 and may be discharged out of a top of the blowing space 105.

Such a configuration guiding air upward may prevent discharged air from flowing directly to a user position in front of or at a side of the blower 1. Such a configuration may also facilitate a circulation of air in an indoor space. For example, when an air conditioner and a blower may be used simultaneously, the blower 1 may be operated to create an upward air flow to promote convection of indoor air, and indoor air may be cooled or heated more quickly.

Figure 18:
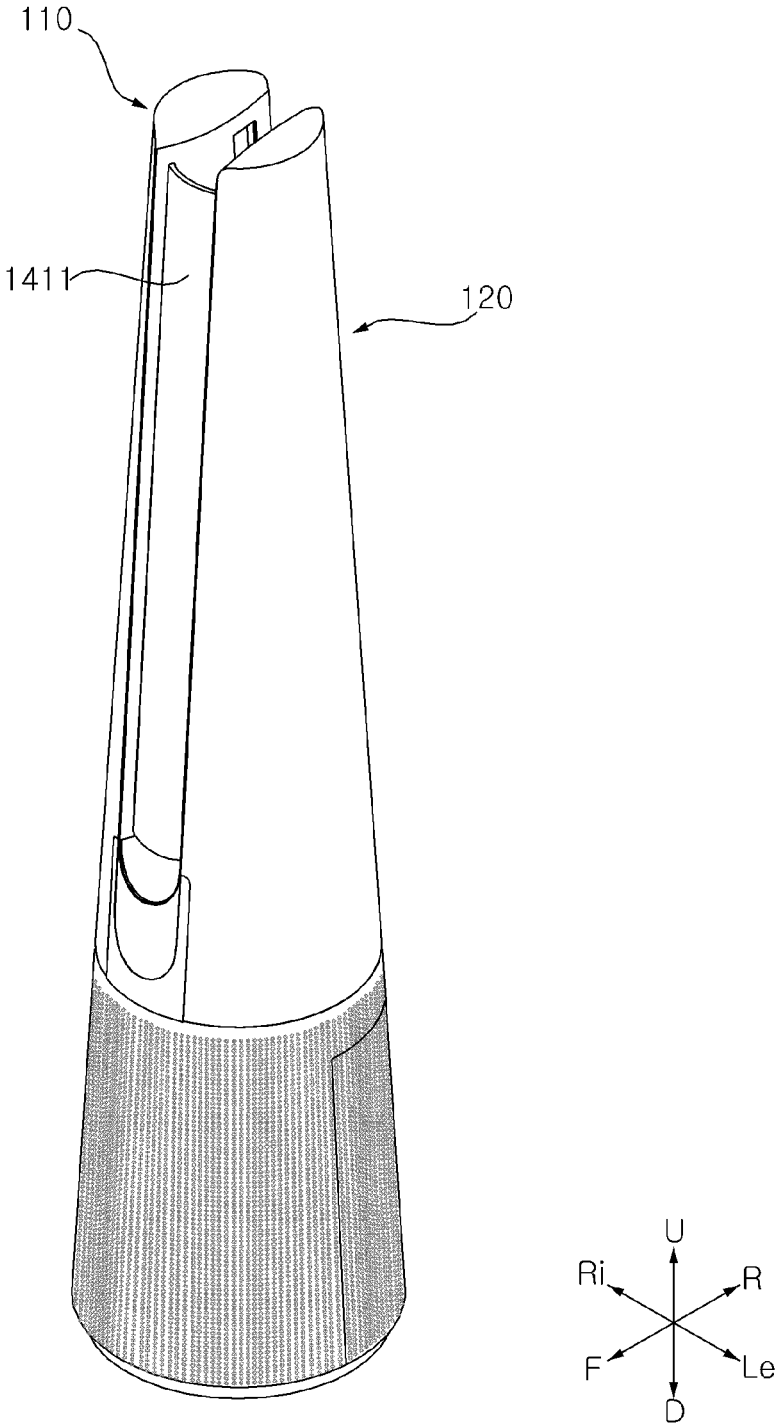
FIG. 18 is a perspective view illustrating a blower according to a second embodiment.
Figure 19:
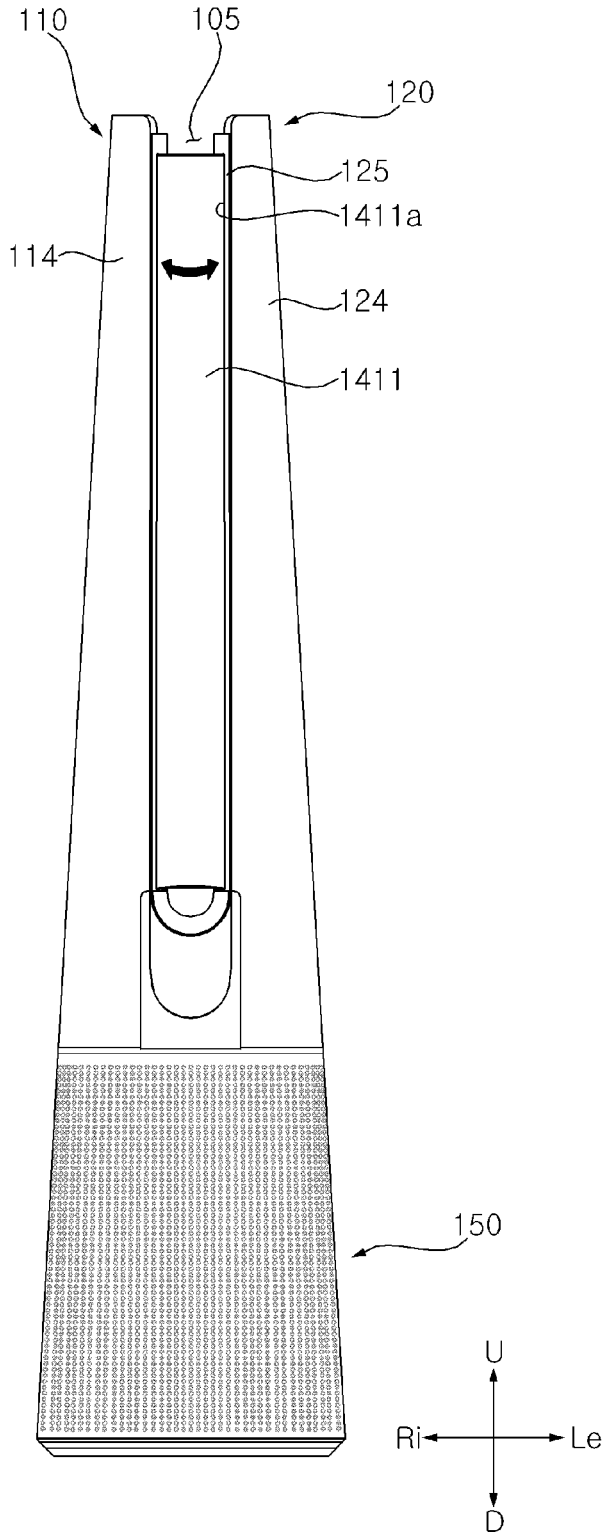
FIG. 19 is a front view of FIG. 18.
Figure 20:
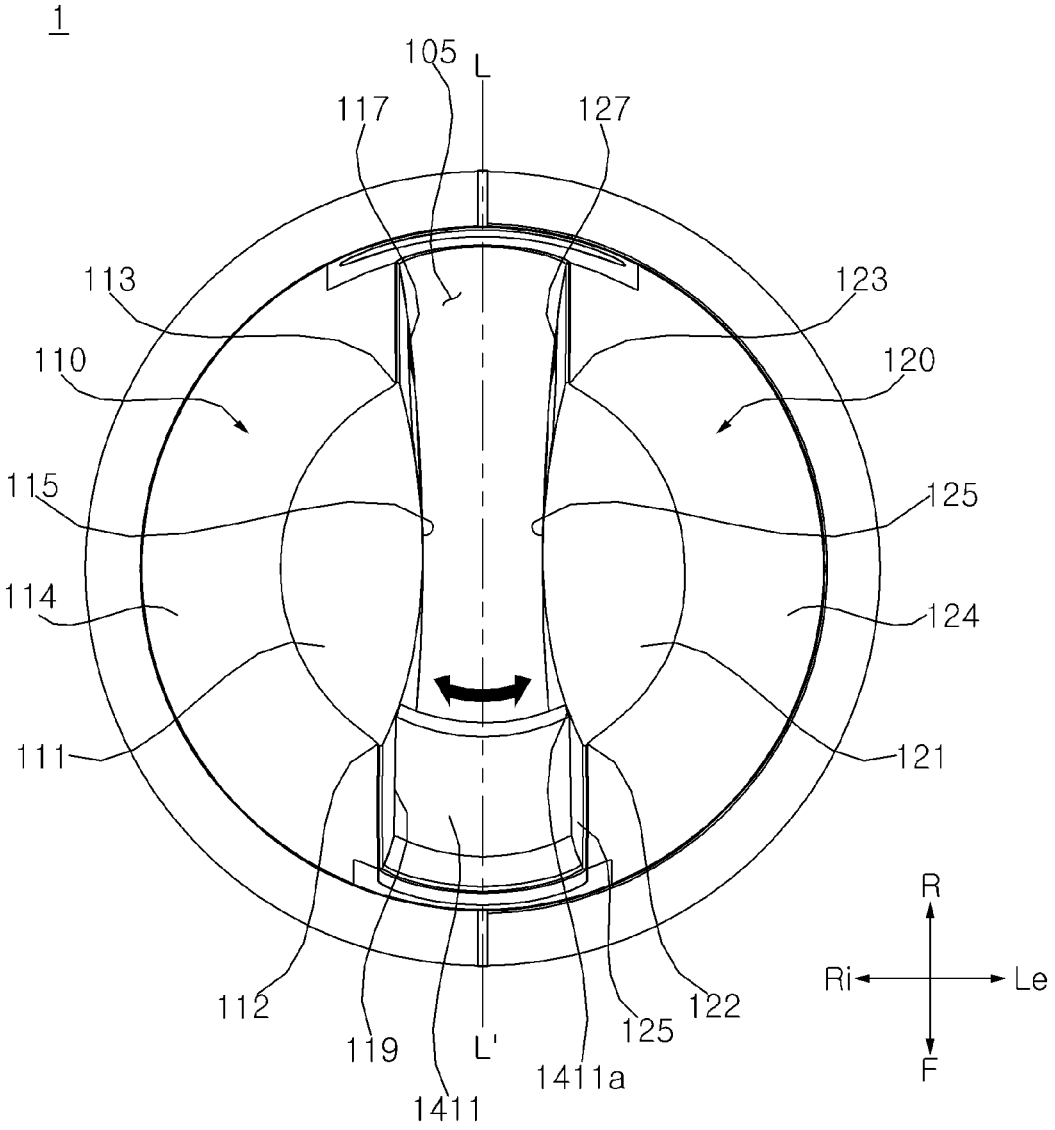
FIG. 20 is a plan view of FIG. 19.
Figure 21:
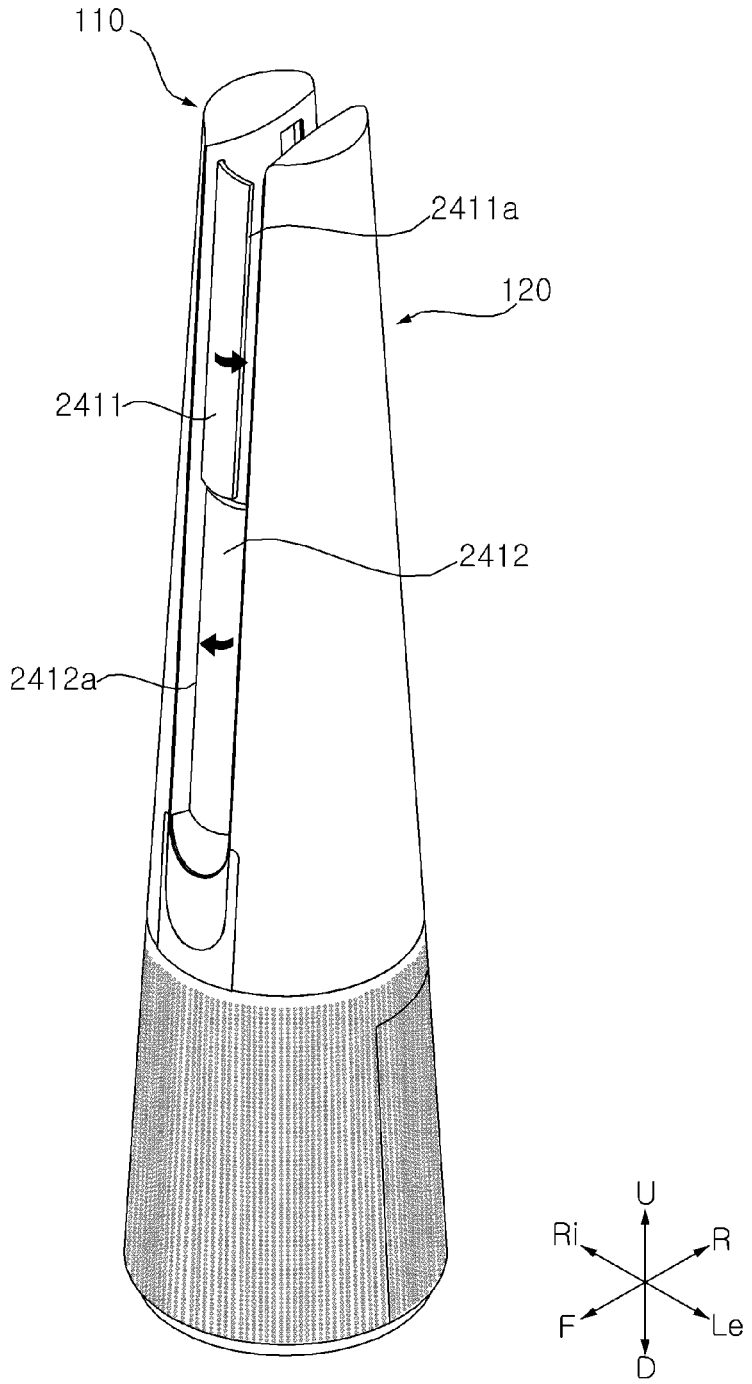
FIG. 21 is a perspective view illustrating a blower according to a third embodiment.
Figure 22:
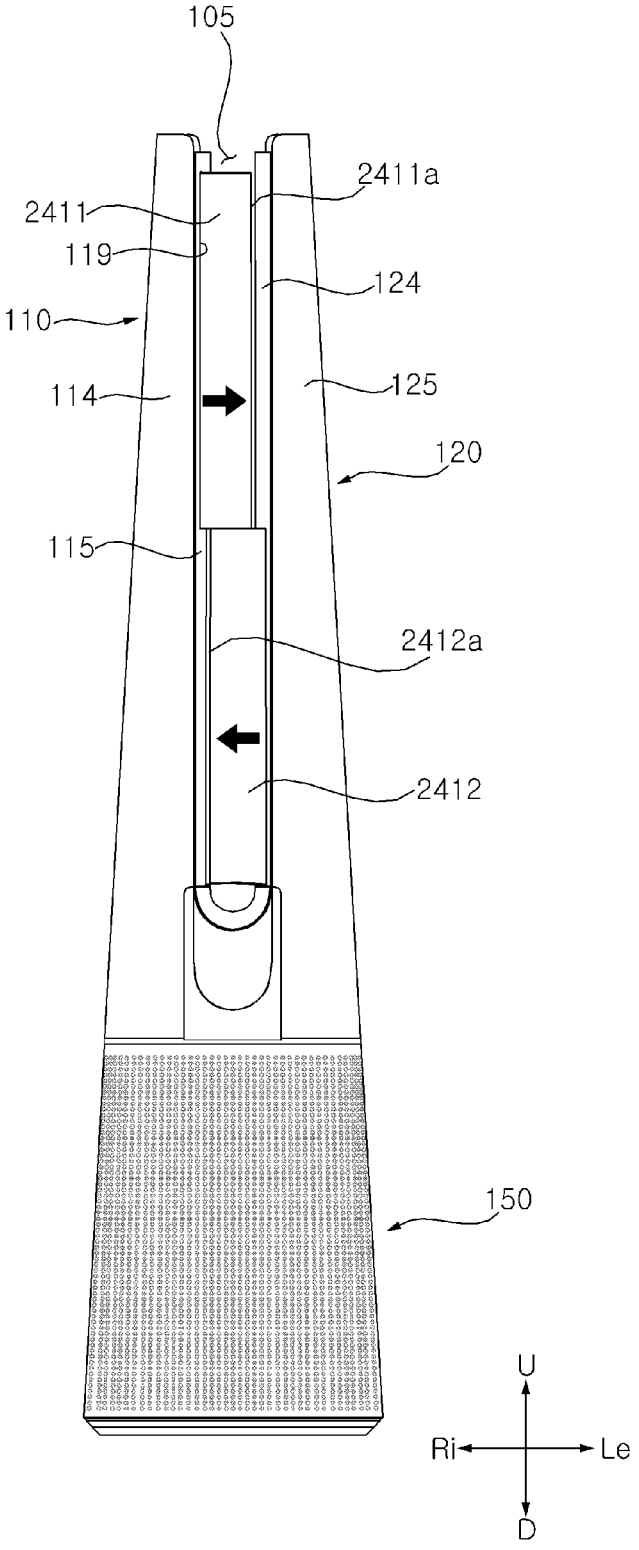
FIG. 22 is a front view of FIG. 21.

A blower according to a second embodiment of the present disclosure will be described with reference to FIGS. 18 to 20. Referring to FIGS. 18-20, the air flow converter may be provided in either the first tower 110 or the second tower 120. Hereinafter, an air flow converter provided in the first tower 110 will be described. However, such an air flow converter may be equally provided in the second tower 120.

The air flow converter may be provided in the first tower 110. A gate 1411 may pass through the first board slot or slit 119 and protrude into the blowing space 105. The gate 1411 may be rotated until an inner end 1411*a* contacts the inner surface 125 of the second tower 120.

The front of the blowing space 105 may be closed by changing the position of the gate 1411. The air flowing in the blowing space 105 may flow upward. Depending on a use case or setting, the gate 1411 may be provided to be slightly spaced apart and not contacting the second (opposite) tower 120.

Since only one gate 1411 may be used, there may be an advantage that components or a configuration may be simplified. A guide motor, a gear device, and a board guide for moving the gate 1411 may be applied in the same manner as the configurations described in FIGS. 12 to 15.

Hereinafter, a blower according to a third embodiment of the present disclosure will be described with reference to FIGS. 21 to 25C. Referring to FIGS. 21-25C, the blower may include a first or upper air flow converter and a second or lower air flow converter. The first air flow converter may have a first or upper gate 2411 configured to protrude into the upper side of the blowing space 105, and the second air flow converter may have a second or lower gate 2412 configured to protrude into the lower side of the blowing space 105.

The first gate 2411 may be provided in the first tower 110, and the second gate 2412 may be provided in the second tower 120, but embodiments disclosed herein are not limited to such an arrangement. For example, as an alternative, the second gate 2412 provided in the second tower 120 may be provided above the first gate 2411. As another alternative, both the first and second gates 2411 and 2412 may be provided inside of a same tower (e.g., first tower 110).

The first gate 2411 and the second gate 2412 may be operated separately. A height of the first gate 2411 protruding to the blowing space 105 may be formed to be different from a height of the second gate 2412 protruding to the blowing space 105. Due to an independent operation, it's possible for only one of the first gate 2411 and the second gate 2412 to protrude into the blowing space 105 while the other of the first and second gates 2411 and 2412 may be inserted inside of the tower 110 or 120.

The first gate 2411 and the second gate 2412 may be provided in front of the blowing space 105. The first gate 2411 and the second gate 2412 may open or close the front of the blowing space 105 depending on a position or arrangement.

A length of each of the first gate 2411 and the second gate 2412 formed in the vertical direction may be shorter than the length of the first discharge port 117 or the second discharge port 127 formed in the vertical direction.

When the first gate 2411 and the second gate 2412 are provided to protrude or be inserted into the blowing space 105, the lower end of the first gate 2411 and the upper end of the second gate 2412 may contact each other.

A first board slit 119 may be formed in the inner wall 115 of the first tower 110 and a second board slit 129 may be formed in the inner wall 125 of the second tower 120. The first board slit 119 may be provided above the second board slit 129.

A first board groove 116 into which an inner end 2412*a* of the second gate 2412 may be inserted may be formed in the inner wall 115 of the first tower 110. A second board groove 126 into which an inner end 2411*a* of the first gate 2411 may be inserted may be formed in the inner wall 125 of the second tower 120.

Figure 24A:
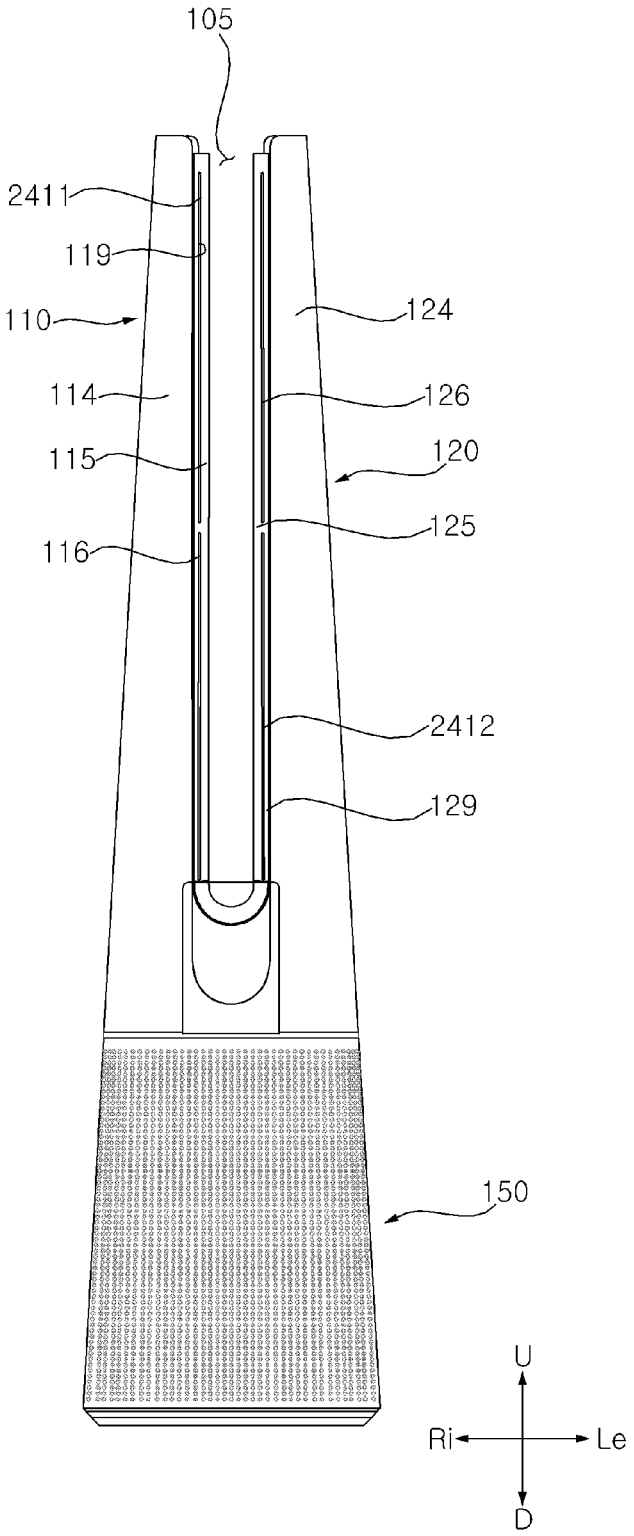
FIG. 24A is a front view of a blower in a state in which a first gate and a second gate are provided in a first position P1 according to the third embodiment.
Figure 24B:
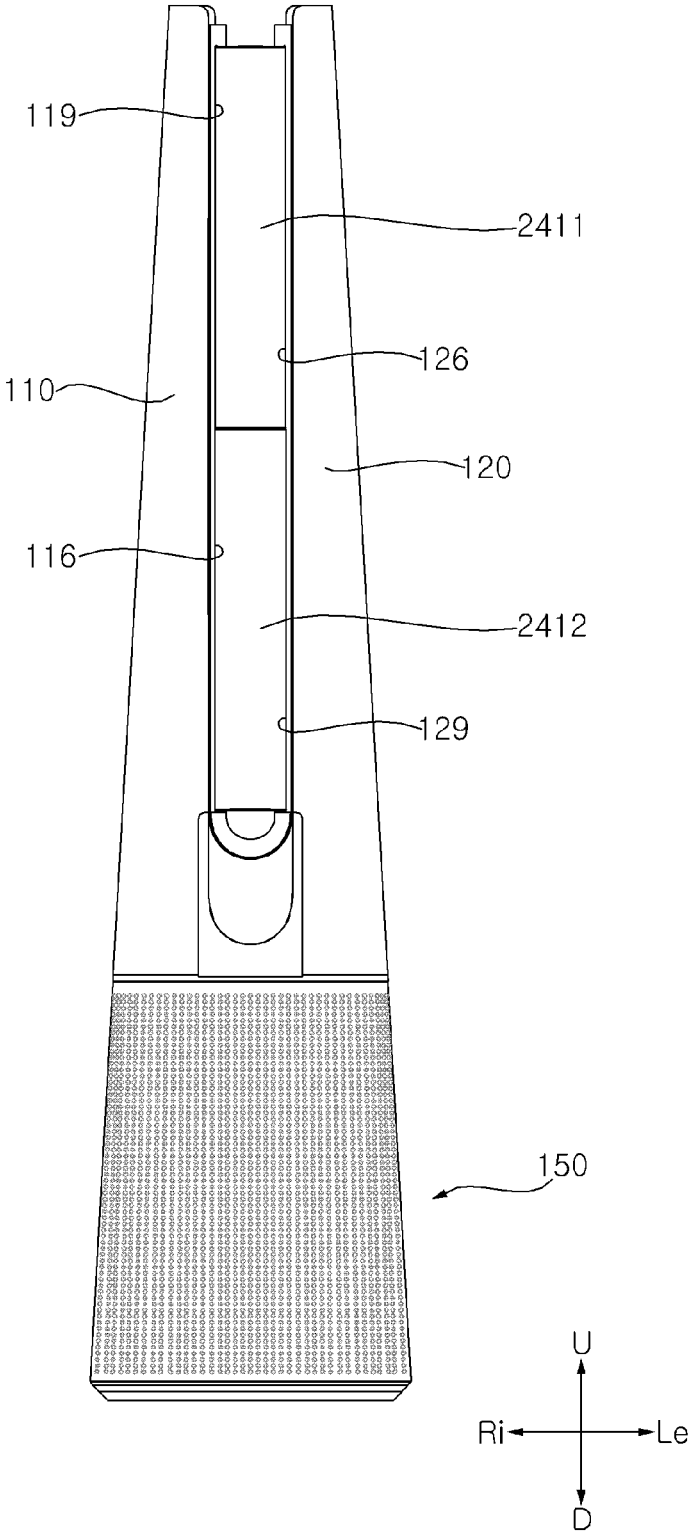
FIG. 24B is a front view of a blower in a state in which the first gate and the second gate are provided in a second position P2 according to the third embodiment.
Figure 25A:
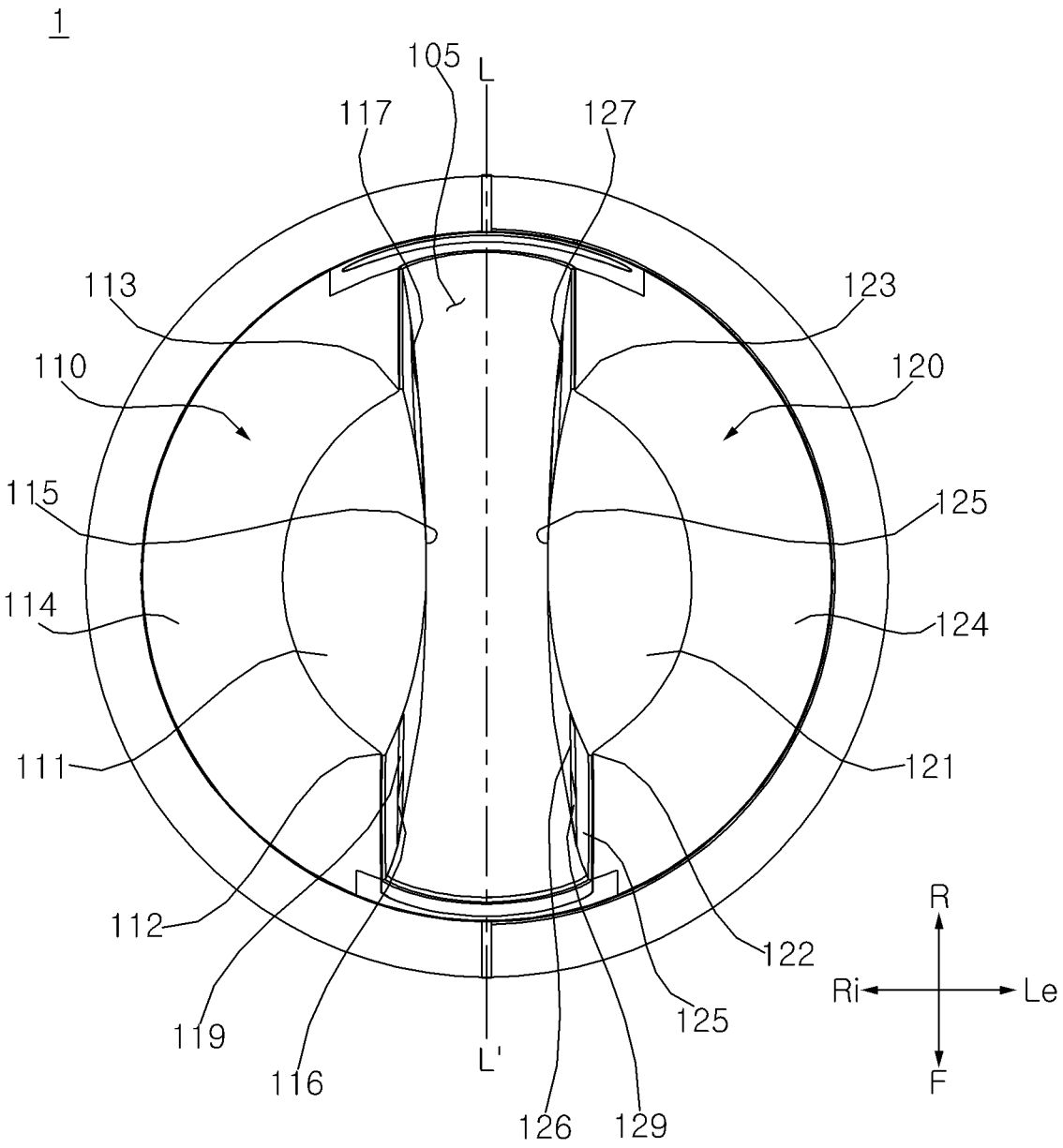
FIG. 25A is a plan view of FIG. 24A.
Figure 25B:
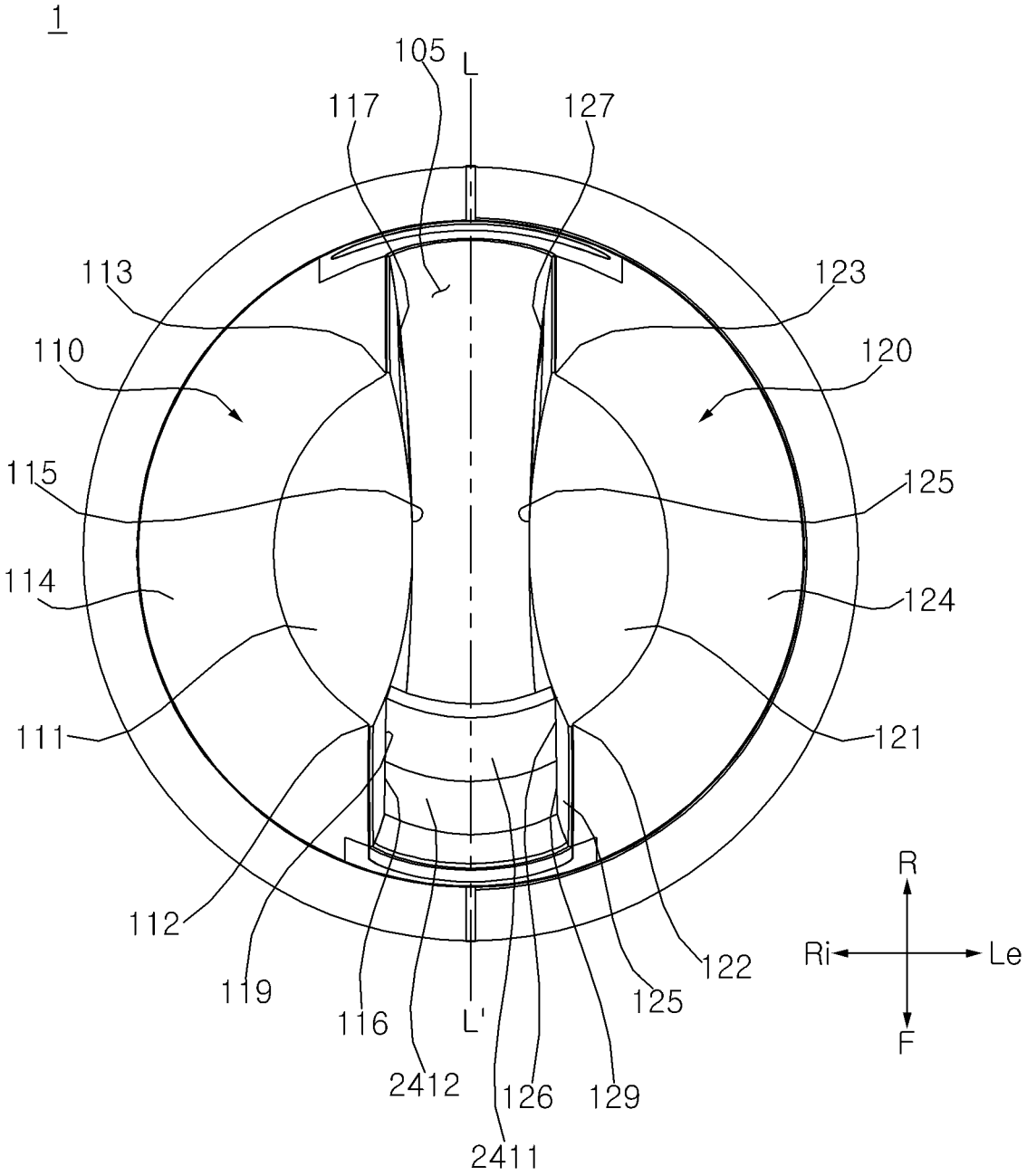
FIG. 25B is a plan view of FIG. 24B.

As shown in FIGS. 24B and 25B, when the first gate 2411 protrudes a maximum amount or an amount sufficient to close a top of the blowing space 105, the inner end 2411*a* of the first gate 2411 may be inserted to the second board groove 126. When the second gate 2412 protrudes a maximum amount or an amount sufficient to close a bottom of the blowing space 105, the inner end 2412*a* of the second gate 2412 may be inserted into the first board groove 116.

Figure 23:
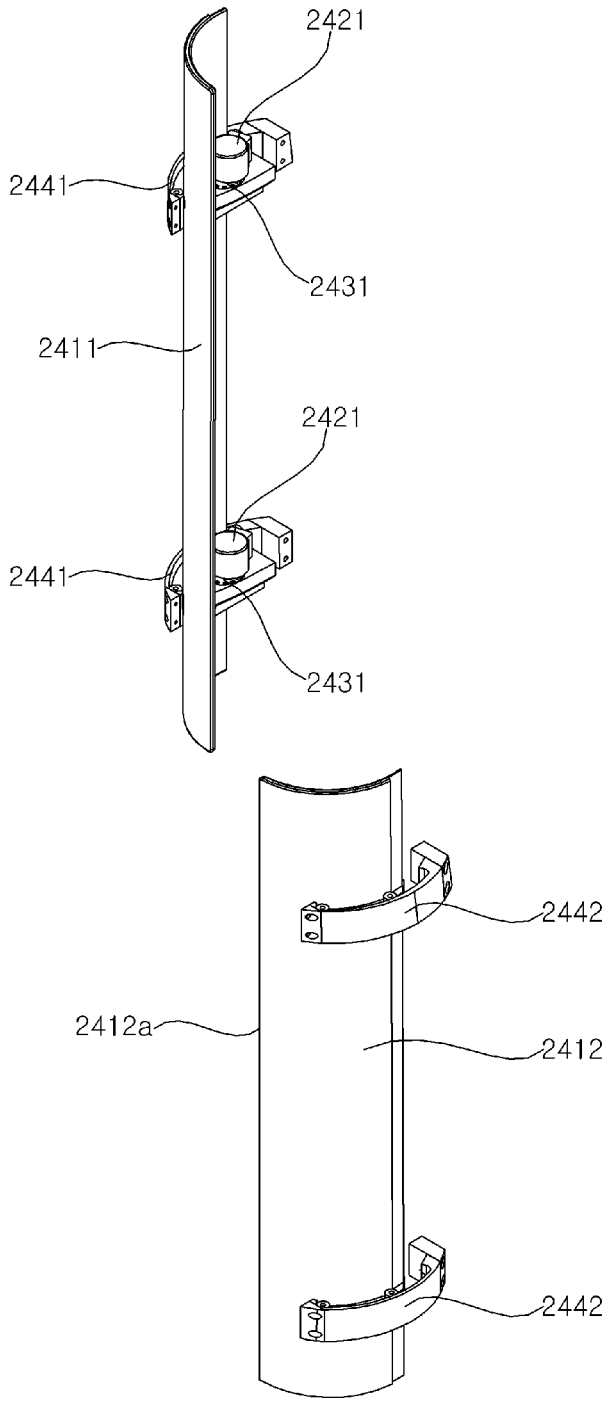
FIG. 23 is a perspective view of an air flow converter according to a third embodiment.

Referring to FIG. 23, the first air flow converter may include a first guide motor 2421 that provides a driving force for the movement of the first gate 2411, a first gear device 2431 that provides a driving force of the first guide motor 2421 to the first gate 2411, and a first gate guider 2441 which may be provided inside the first tower 110 and guides the movement of the first gate 2411. Similarly, the second air flow converter may include a second guide motor that provides a driving force for the movement of the second gate 2412, a second gear device that provides a driving force of the second guide motor to the second gate 2412, and a second gate guider 2442 which may be provided inside the second tower 120 and guides the movement of the second gate 2412.

The first air flow converter may be provided above the second air flow converter. The lower end of the first gate 2411 may be provided above the upper end of the second gate 2412.

A detailed configuration and function of the first air flow converter and the second air flow converter may be identically applied with the air flow converter described with reference to FIGS. 12 to 15. Hereinafter, an arrangement of the first gate 2411 and the second gate 2412 will be described with reference to FIGS. 24A to 25C.

Referring to FIGS. 24A-25C, the first gate 2411 and the second gate 2412 may be provided in a first position P1 that allows air flowing through the blowing space 105 to flow forward, a second position P2 that guide air flowing through the blowing space 105 upward, and a third position P3 provided between the first position P1 and the second position P2.

Referring to FIGS. 24A and 25A, in the first position P1, the first gate 2411 may be provided inside the first tower 110, and the second gate 2412 may be provided inside the second tower 120. In the first position P1, the front of the blowing space 105 may be open. Air flowing through the blowing space 105 through the discharge port s117, 127 may be discharged to the front to form a horizontal airflow.

Referring to FIGS. 24B and 25B, in the second position P2, the inner end 2411*a* of the first gate 2411 may contact the second tower 120 and be provided in the second board groove 126 formed in the second tower 120. The inner end 2412*a* of the second gate 2412 may contact the first tower 110 and be provided in the first board groove 116 formed in the first tower 110. The lower end of the first gate 2411 may be provided to be in contact with the upper end of the second gate 2412.

Air flowing through the blowing space 105 may be guided upward by the first gate 2411 and the second gate 2412. The air that flows in the blowing space 105 through the discharge ports 117, 127 may be discharged upward to form an upward airflow.

Figure 24C:
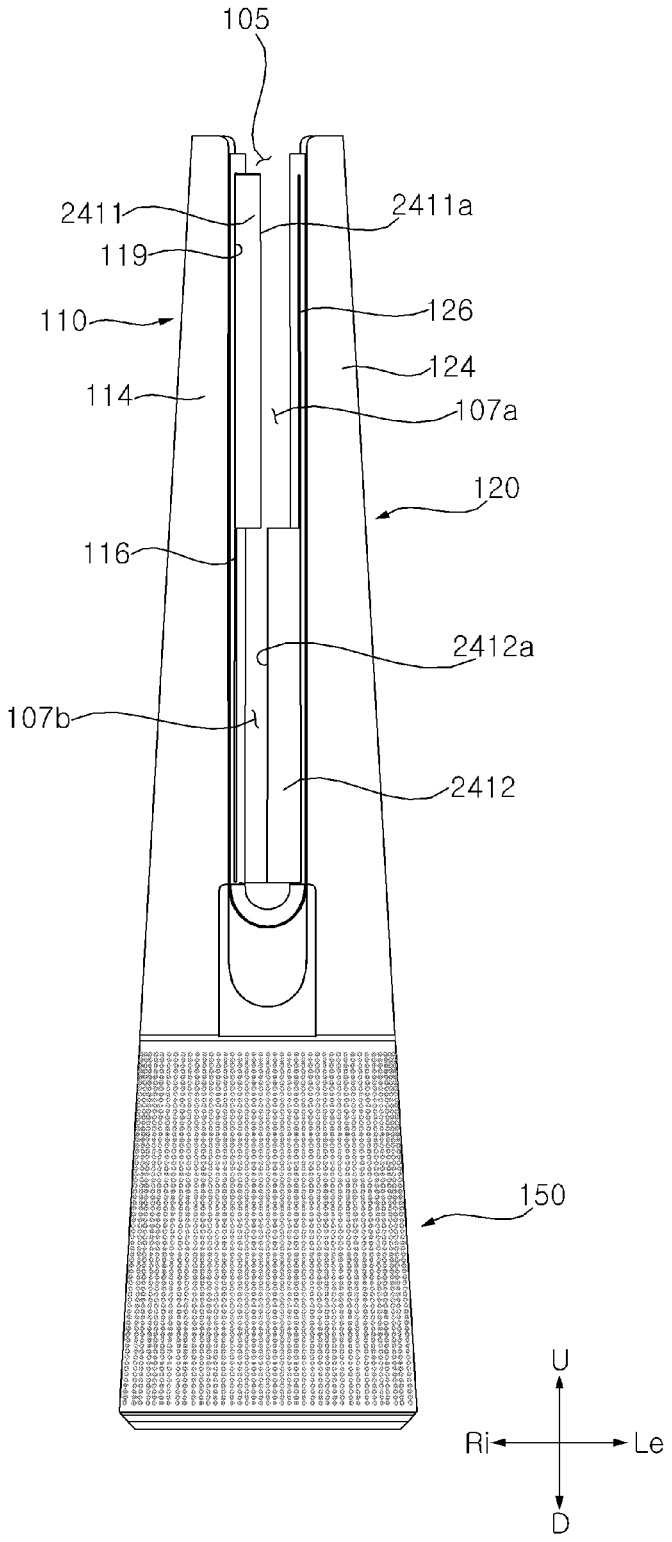
FIG. 24C is a front view of a blower in a state in which the first gate and the second gate are provided in a third position P3 according to the third embodiment.
Figure 25C:
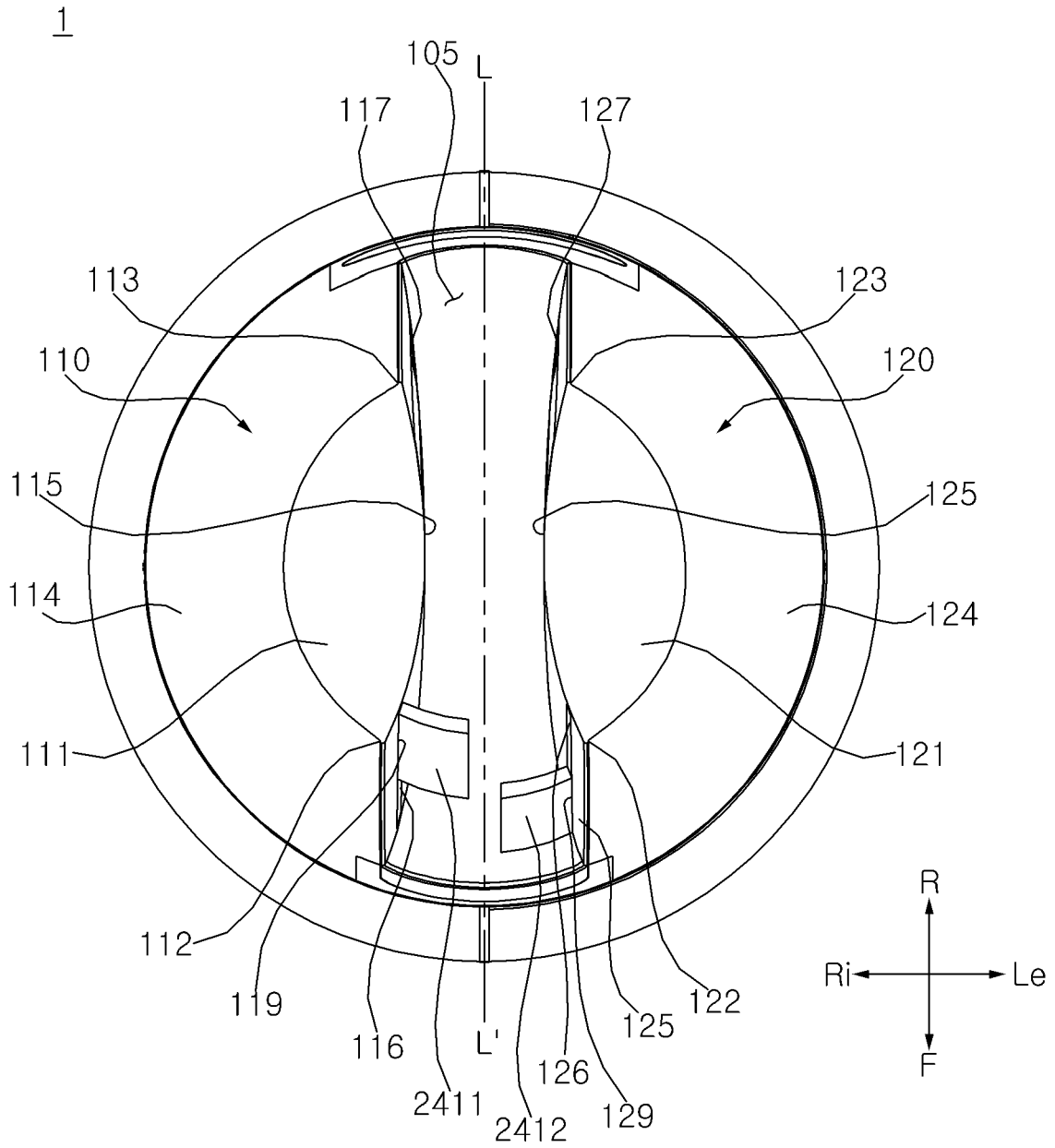
FIG. 25C is a plan view of FIG. 24C.

Referring to FIGS. 24C and 25C, in the third position P3, the first gate 2411 may protrude into the blowing space 105 so that the inner end 2411*a* does not contact the second tower 120. The inner end 2411*a* of the first gate 2411 may be provided to be spaced apart from the second tower 120 by a certain or predetermined distance or interval. The second gate 2412 may protrude into the blowing space 105 so that the inner end 2412*a* does not contact the first tower 110. The inner end 2412*a* of the second gate 2412 may be provided to be spaced apart from the first tower 110 by a certain or predetermined distance or interval.

A first front gap 107*a* may be formed between the first gate 2411 and the second tower 127, and a second front gap 107*b* may be formed between the second gate 2412 and the first tower 117. Air flowing toward the front of the blowing space 105 may flow through the first and second front gaps 107*a* and 107*b*.

Air flowing through the blowing space 105 may be guided to the left and right sides of the front. The air flowing through the blowing space 105 may be discharged through the first front gap 107*a* and the second front gap 107*b*. Air may be discharged in a wide forward direction.

Figure 26:
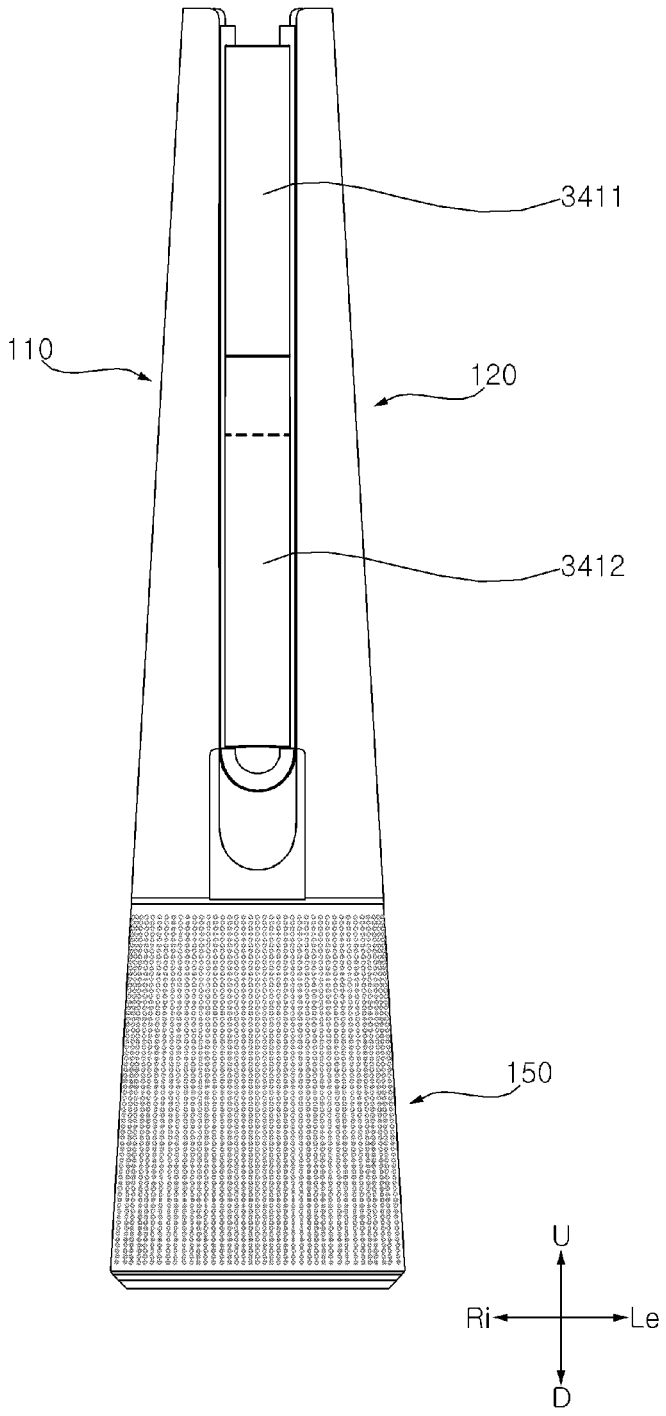
FIG. 26 is a front view of a blower according to a fourth embodiment of the present disclosure.

A blower according to a fourth embodiment will be described with reference to FIGS. 26 to 27. Differences between the third and fourth embodiments will be primarily described, while similar descriptions will be omitted.

A first gate 3411 may be provided above a second gate 3412. Referring to FIG. 26, a lower end of the first gate 3411 may be provided to be overlapped with an upper end of the second gate 3412.

Figure 27:
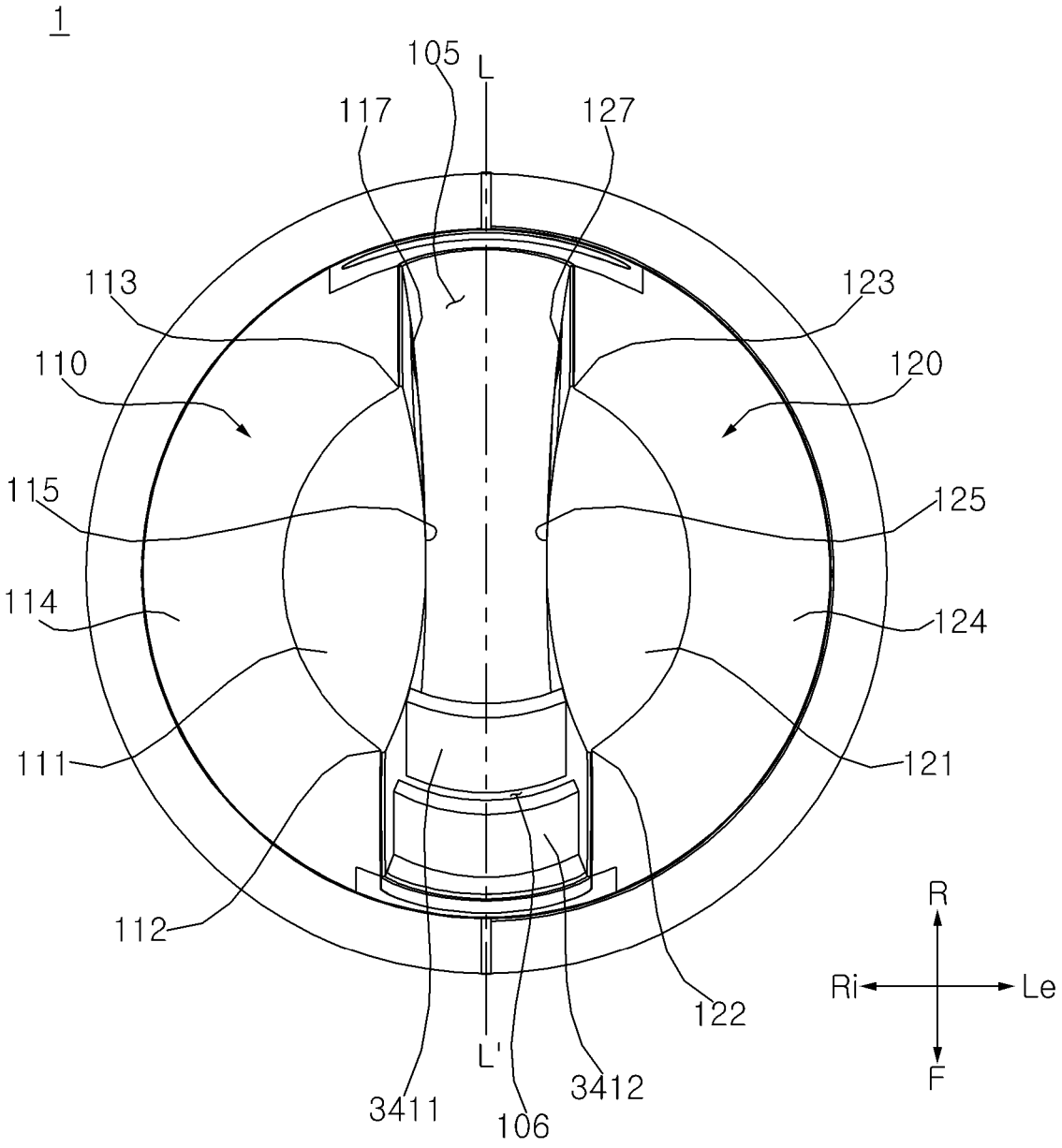
FIG. 27 is a plan view of FIG. 26.

Referring to FIG. 27, the first gate 3411 may be provided at a rear side of the second gate 3412. When the first gate 3411 contacts the second tower 120 and the second gate 3412 contacts the first tower 110, a hole or space 106 extending in the vertical direction may be formed between the first gate 3411 and the second gate 3412.

The air flowing through the blowing space 105 may flow upward along the first gate 3411 and the second gate 3412. Part of the air flowing upward may flow through the hole 106. The air flowing through the blowing space 105 may flow upward along an inner surface of the second gate 3412, pass through the hole 106, and may flow upward along an outer surface of the first gate 3411.

Embodiments disclosed herein may provide air discharged from a blower that forms an upward airflow in addition to a horizontal airflow, thereby forming air circulation in the indoor space. A plurality of gates may be provided in the vertical direction and may be in close contact with an opposite tower to block a blowing space so that the horizontal airflow may be converted into an upward airflow.

Embodiments disclosed herein may solve the above and other problems. Embodiments disclosed herein may provide a blower capable of selectively providing a horizontal airflow or an upward airflow. Embodiments disclosed herein may provide a blower that generates airflow in various directions. Embodiments disclosed herein may provide a blower that can effectively block an air flow front.

Embodiments disclosed herein may provide a blower including a first tower, a second tower, a fan, a gate, and a guide motor. The first tower may have a first discharge port formed in a first wall. The second tower may have a second wall facing the first wall and spaced apart from the first wall. A second discharge port may be formed in the second wall. The fan may be provided below the first tower and the second tower and form an air flow in each of the first tower and the second tower. The gate may be movably provided in at least one of the first tower or the second tower. The guide motor may change a disposition or position of the gate. A blowing space may be formed between the first wall and the second wall. Air discharged from the first discharge port and the second discharge port may flow in the blowing space.

Front, rear, and upper sides of the blowing space may be open. The gate may be provided in a front side of the blowing space. The gate may be provided inside at least one of the first tower or the second tower, or provided to protrude to the blowing space so as to adjust a wind direction of air flowing forward in the blowing space, thereby adjusting a wind direction of the air flowing in the blowing space.

The gate may include a first gate which is provided to be movable in the first tower and a second gate which is provided to be movable in the second tower. The second gate may be provided below the first gate. The guide motor may include a first guide motor to change a disposition or position of the first gate, and a second guide motor to change a disposition or position of the second gate, thereby adjusting the wind direction of the air discharged to the front of the blowing space. The first guide motor and the second guide motor may individually operate the first gate and the second gate respectively, so that the first gate and the second gate may protrude to the blowing space at different heights.

A length of the first gate or the second gate formed in a vertical direction may be shorter than a length of the first discharge port or the second discharge port formed in a vertical direction, thereby securing an amount of air discharged from the discharge port. The first gate and the second gate may move in a direction parallel to each other so that no interference occurs at the lower end of the first gate and the upper end of the second gate.

A first board slit through which the first gate passes may be formed in the first tower, and a second board slit through which the second gate passes may be formed in the second tower. The first board slit and the second board slit may be formed at different heights. The first gate and the second gate may move without interfering with each other.

The first tower may have a first board groove which is provided in a lower side of the first board slit and formed so as to insert an end of the second gate, and the second tower may have a second board groove which is provided in an upper side of the second board slit and formed so as to insert an end of the first gate, so that the first gate and the second gate may block air flow to the front of the blowing space.

The blower may further include a first board or gate guider which is provided inside the first tower to guide a movement of the first gate, and a second board or gate guider which is provided inside the second tower to guide a movement of the second gate. Each of the first board guider and the second board guider may form the movement of the first gate and the second gate in parallel, so that the first gate and the second gate can move without interfering with each other.

The first gate and the second gate may form a curved surface that is convex toward a front, thereby reducing or minimizing the internal size of the first tower and the second tower. The first gate and the second gate may be provided inside each of the first tower and the second tower at a first position forming a horizontal airflow, so that the front of the blowing space can be opened. In addition, the first gate and the second gate may be provided so that an end of the first gate is in contact with the second tower and an end of the second gate is in contact with the first tower at a second position forming an upward airflow, so that the front of the blowing space can be closed.

At the second position, a lower end of the first gate may be in contact with an upper end of the second gate so that the front of the blowing space can be closed at the second position.

At the second position, the first gate may be provided at a rear side of the second gate, so that at the second position, air can be discharged into the space between the first gate and the second gate.

A lower end of the first gate may be provided to be lower than an upper end of the second gate so that air rising along the inner surface of the second gate may flow along the outer surface of the first gate. A hole through which an air rising along the second gate is discharged may be formed between a lower end of the first gate and an upper end of the second gate, so that at the second position, air flowing through the blowing space can flow upward through the hole.

Embodiments disclosed herein may be implemented as a blower comprising a first tower extending in a vertical direction, the first tower having a first wall and a first discharge port formed in the first wall, a second tower extending in the vertical direction and spaced apart from the first tower to form a space therebetween, the second tower having a second wall facing the first wall and a second discharge port formed in the second wall, a fan provided below the first and second towers and configured to discharge air to an inside of the first and second towers, wherein air may be discharged through the first and second discharge ports to create an airflow through the space, at least one gate provided in at least one of the first or second towers, and at least one motor configured to move the gate to adjust a direction of air flowing out of the space. The first and second walls may define sides of the space. The motor may be configured to move the gate to a position that at least partially covers a front of the space to selectively damper air discharged out of the space.

The at least one gate may include a first gate provided in the first tower, and a second gate provided in the second tower. The at least one motor may include a first motor configured to move the first gate, and a second motor configured to move the second gate. The first motor and the second motor may individually operate the first gate and the second gate, respectively.

A vertical length of the first gate may be shorter than a vertical length of the first discharge port. The first gate and the second gate may have movement paths that are parallel to each other. The second gate may be provided below the first gate such that the first gate may be configured to cover an upper front of the space and the second gate may be configured to cover a lower front of the space.

A first slit may be formed in the first tower, and a second slit may be formed in the second tower. The first gate may be configured to move through the first slit, and the second gate may be configured to move through the second slit. The first slit and the second slit may be formed at different heights. The first tower may have a first groove provided below the first slit and configured to receive an end of the second gate. The second tower may have a second groove provided above the second slit and configured to receive an end of the first gate.

A first guide may be provided inside the first tower and configured to guide a movement of the first gate. A second guide may be provided inside the second tower and configured to guide a movement of the second gate such that movement paths of the first and second gates are parallel to each other. Each of the first gate and the second gate may have a convex curvature such that the first and second gates are curved toward a front of the blower.

When the first gate and the second gate are provided at a first position inside of the first and second towers, air may flow in a forward direction to be discharged out of the front of the space. When the first gate and the second gate are provided at a second position to collectively cover the front of the space, air may be guided along an inner surface of at least one of the first or second gates to be guided upward to be discharged out of a top of the space.

At the second position, an end of the first gate may contact the second tower and an end of the second gate contacts the first tower. At the second position, a lower end of the first gate may be in contact with an upper end of the second gate. At the second position, the first gate may be provided behind the second gate.

A lower end of the first gate may be provided to be lower than an upper end of the second gate. A hole may be formed between a lower end of the first gate and an upper end of the second gate, and air rising along the second gate may be discharged through the hole.

Embodiments disclosed herein may be implemented as a blower comprising a lower case having an inlet, an upper case having a first tower and a second tower that are spaced apart from each other to form a space therebetween, the first and second towers being joined at a bottom, a first outlet formed in the first tower and configured such that air may be discharged out of the first outlet at a rear of the space, a second outlet formed in the second tower and configured such that air may be discharged out of the second outlet at the rear of the space, a fan provided below the first and second towers, a first slit formed in the first tower, and a first gate provided in the first tower and configured to move through the first slit such that the first gate may be configured to damper the air flowing out of the space.

A motor and a rack and pinion structure may move the first gate through the first slit. The first gate may have an arc shape.

A second slit may be formed in the second tower. A second gate may be provided in the second tower and may be configured to move through the second slit such that the first and second gates together cover and uncover the front of the space.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a first tower extending in a vertical direction, the first tower having a first wall and a first discharge port formed in the first wall;

a second tower extending in the vertical direction and spaced apart from the first tower to form a space therebetween, the second tower having a second wall facing the first wall and a second discharge port formed in the second wall;

a fan provided at a lower side of the first and second towers and configured to discharge air to an inside of the first and second towers, wherein air is discharged through the first and second discharge ports to create an airflow through the space;

at least one gate movably disposed in at least one of the first or second towers; and at least one motor configured to move the at least one gate, and wherein front, rear and upper sides of the space are open, wherein the at least one gate protrudes to the front side of the space such to that selectively change an airflow direction as forward or upward, when the at least one gate opens the front side of the space as the at least one gate is provided inside of the at least one of the first or second towers, air flows in a forward direction to be discharged out of the front side of the space, and when the at least one gate collectively covers the front side of the space as the at least one gate protrudes to the space, air is guided along an inner surface of the at least one gate to be guided upward to be discharged out of the upper side of the space.

2. The blower of claim 1, wherein the at least one gate includes:

a first gate provided in the first tower, and a second gate provided in the second tower; and wherein the at least one motor includes:

a first motor configured to move the first gate, and a second motor configured to move the second gate.

3. The blower of claim 1, wherein a vertical length of the at least one gate is shorter than a vertical length of the first discharge port or the second discharge port.

4. The blower of claim 2, wherein the second gate is provided below the first gate such that the first gate is configured to cover an upper front of the space and the second gate is configured to cover a lower front of the space, and wherein the first gate and the second gate have movement paths that are parallel to each other.

5. The blower of claim 2, wherein a first slit is formed in the first tower, a second slit is formed in the second tower, the first gate is configured to move through the first slit, and the second gate is configured to move through the second slit.

6. The blower of claim 5, wherein the first slit and the second slit are formed at different heights.

7. The blower of claim 6, wherein the first tower has a first groove provided below the first slit and configured to receive an end of the second gate, and the second tower has a second groove provided above the second slit and configured to receive an end of the first gate.

8. The blower of claim 2, when the first gate and the second gate are provided at a first position inside of the first and second towers, air flows in the forward direction to be discharged out of the front side of the space, and when the first gate and the second gate are provided at a second position to collectively cover the front side of the space, air is guided along an inner surface of at least one of the first or second gates to be guided upward to be discharged out of the upper side of the space.

9. The blower of claim 8, wherein, at the second position, an end of the first gate contacts an end of the second gate in the space.

10. The blower of claim 8, wherein at the second position, a lower end of the first gate is in contact with an upper end of the second gate.

11. The blower of claim 8, wherein at the second position, the first gate is provided behind the second gate.

12. The blower of claim 11, wherein a lower end of the first gate is provided to be lower than an upper end of the second gate.

13. The blower of claim 11, wherein a hole is formed between a lower end of the first gate and an upper end of the second gate, and air rising along the second gate is discharged through the hole.

14. The blower of claim 1, wherein the at least one gate has a convex curvature curved toward a front of the blower.

15. The blower of claim 1, wherein the first and second discharge ports are disposed backward from the at least one gate, and the first and second discharge ports are configured to discharge air frontward.

16. The blower of claim 1, wherein the first discharge port is disposed near a rear end of the first wall, and the second discharge port is disposed near a rear end of the second wall, wherein the at least one gate is disposed near a front end of the first or second wall.

17. The blower of claim 16, wherein a distance between the first wall and the second wall is shortest at a central part between the first and second discharge ports and the at least one gate.

18. The blower of claim 1, the at least one gate is tilted toward the first and second discharge ports such that a distance between the at least one gate and the first and second discharge ports gets closer in the upward direction.

19. The blower of claim 18, wherein the at least one gate protrudes to the space or moves into the first or second tower while tilted toward the first and second discharge ports.

20. The blower of claim 1, when the at least one gate opens the front side of the space, an opening of the front side of the space is biased to the first wall or the second wall such that the air flowing in the forward direction is biased in left-right direction.

21. The blower of claim 1, wherein the at least one gate is provided as a singular gate which is disposed in one of the first tower or the second tower, and when the singular gate covers the front side of the space based on the singular gate contacting the other of the first tower or the second tower, air is guided along the inner surface of the singular gate to be guided upward to be discharged out of the upper side of the space.

* * * * *